US010261461B2

(12) United States Patent
Kobayashi

(10) Patent No.: US 10,261,461 B2
(45) Date of Patent: Apr. 16, 2019

(54) APPARATUS FOR CUTTING CORNERS AND APPARATUS FOR FORMING IMAGES PROVIDED WITH THE APPARATUS

(71) Applicant: Misao Kobayashi, Yamanashi-ken (JP)

(72) Inventor: Misao Kobayashi, Yamanashi-ken (JP)

(73) Assignee: CANON FINETECH NISCA INC., Misato-Shi, Saitama (JP)

( * ) Notice: Subject to any disclaimer, the term of this patent is extended or adjusted under 35 U.S.C. 154(b) by 0 days.

(21) Appl. No.: 15/367,998

(22) Filed: Dec. 2, 2016

(65) Prior Publication Data

US 2017/0160693 A1 Jun. 8, 2017

(30) Foreign Application Priority Data

Dec. 7, 2015 (JP) ..... 2015-238732
Dec. 7, 2015 (JP) ..... 2015-238733
Dec. 7, 2015 (JP) ..... 2015-238734
Dec. 7, 2015 (JP) ..... 2015-238735

(51) Int. Cl.
*G03G 15/00* (2006.01)
*B26D 9/00* (2006.01)

(52) U.S. Cl.
CPC ..... *G03G 15/6582* (2013.01); *B26D 9/00* (2013.01)

(58) Field of Classification Search
CPC ..... G03G 15/6582
USPC ..... 399/407
See application file for complete search history.

(56) References Cited

U.S. PATENT DOCUMENTS 2,164,616 A * 7/1939 Manny ..... B26D 3/10 29/557
2,926,025 A * 2/1960 Sornberger ..... B26D 9/00 281/38
3,354,768 A * 11/1967 Liick ..... B26F 1/12 83/345
3,408,889 A * 11/1968 Murphy ..... B26F 1/36 83/599
3,411,390 A * 11/1968 Maynard ..... B26D 3/14 493/363
4,442,742 A * 4/1984 Orlow ..... B26D 1/626 83/303
5,540,127 A * 7/1996 Binder ..... H01M 4/16 83/100

(Continued)

FOREIGN PATENT DOCUMENTS

JP H06-156817 A 6/1994
JP 3627073 B2 3/2005
JP 2015-189551 A 11/2015

*Primary Examiner* — Anthony H Nguyen
(74) *Attorney, Agent, or Firm* — Manabu Kanesaka

(57) ABSTRACT

A corner cut apparatus for entering into a transport path for transporting a sheet in a crossing direction to cut corners of the sheet includes a cut blade frame that supports a cut blade shifting with respect to the sheet surface, a receiving blade frame that supports a receiving blade for receiving the shifting cut blade, and a drive member that causes the cut blade frame and the receiving blade frame to enter into the transport path of the sheet, where blade shapes of the cut blade and the receiving blade are a back-to-back shape with an entry direction as a reference line. By this means, it is possible to provide the apparatus for cutting corners at the lead edge and end edge of the sheet in an inclined or curved manner, only by shifting (up and down) the blade with respect to the sheet surface.

9 Claims, 22 Drawing Sheets

(56) References Cited

U.S. PATENT DOCUMENTS

| | | | | |
|---|---|---|---|---|
| 2003/0041712 | A1* | 3/2003 | Tsuruta | B26D 3/10 83/17 |
| 2007/0034068 | A1* | 2/2007 | Chiang | B26D 3/10 83/679 |
| 2014/0121085 | A1* | 5/2014 | Kwarta | B26D 7/2628 483/10 |

* cited by examiner

APPARATUS FOR CUTTING CORNERS AND APPARATUS FOR FORMING IMAGES PROVIDED WITH THE APPARATUS

BACKGROUND OF THE INVENTION

1. Field of the Invention

The present invention relates to an apparatus for cutting corners of a sheet discharged from an image formation apparatus such as a copier and various types of printers in an inclined or curved manner, or concurrently therewith, punching a punch hole in the sheet, and more particularly, to a corner cut apparatus for cutting corners of a transported sheet in an inclined or curved manner, corner cut•punch apparatus further provided with a punch mechanism for punching a punch hole in addition thereto, an image formation apparatus provided with the apparatus, and a sheet corner cut•punch method.

2. Description of the Related Art

In recent years, it has been known widely that predetermined sheet processing is performed on a sheet carried out of an image formation apparatus. Ina sheet processing apparatus coupled to an image formation apparatus, the apparatus is also provided which performs punch blade processing and binding processing.

In addition, since corners of a sheet tend to bend, it is known that the appearance of a sheet shape is improved to add a tender sense by cutting corners on the lead edge or cutting corners of the sheet.

For example, in Japanese Patent Gazette No. 3627073 is shown an apparatus where a sheet is nipped between a shifting arc-shaped cut blade and a receiving blade that receives the cut blade, and the cut blade is manually pressed into the receiving blade toward corners of the sheet to cut the corners of the sheet.

Further, in Japanese Patent Application Publication No. H06-156817 is disclosed an apparatus that is a paper feed apparatus which cuts both corners on the lead edge side of a sheet transported from a sheet storage section that stacks sheets in an inclined or curved manner with a sheet cut mechanism, then feeds the sheet to an image formation apparatus, and thereby reduces a paper jam caused by corner bending of the sheet.

Furthermore, in Japanese Patent Application Publication No. 2015-189551 is disclosed an apparatus targeted for sheets in the shape of a bunch where a cut blade longer than a width of a transported sheet and a punching blade are provided in a single unit, punching is first performed, and subsequently, cutting is performed.

However, the apparatus shown in above-mentioned Japanese Patent Gazette No. 3627073 is to manually cut corners of a sheet, requires a time for cutting, while manually setting a cut range, and therefore, is not stable.

On the other hand, in the apparatus shown in Japanese Patent Application Publication No. H06-156817, it is possible to automatically cut corners of a sheet, but only the lead edge side of the sheet is cut, and it is not possible to cut the end edge side of the sheet. In the case of cutting the sheet end edge, it is considered changing directions of the cut blade and the unit of the cut blade, and it is necessary to use a cut-blade direction changing mechanism.

Further, in the apparatus shown in Japanese Patent Application Publication No. 2015-189551, the cut blade is not capable of cutting corner cuts of the sheet in an inclined or curved manner, and further, since the cut blade is comprised of a blade that is longer than the width of the sheet and that is relatively heavy, it is difficult to downsize the drive and the entire apparatus.

The present invention was made in view of the above-mentioned problems, and it is a first object of the invention to provide a corner cut apparatus which enters in a direction crossing a transport path of a sheet to cut corners at the lead edge and end edge of a transported sheet in an inclined or curved manner. Further, it is a second object to provide a corner cut•punch apparatus by providing the apparatus with a punch blade to also enable a hole to be punched.

SUMMARY OF THE INVENTION

In order to attain the above-mentioned objects, according to the first disclosure of the present invention, a corner cut apparatus includes a transport path for transporting a sheet to enter into the transport path in a crossing direction so as to cut corners of the sheet, and is provided with a cut blade frame that supports a cut blade shifting with respect to a sheet surface, a receiving blade frame that supports a receiving blade for receiving the shifting cut blade, and a drive member that causes the cut blade frame and the receiving blade frame to enter into the transport path of the sheet, where blade shapes of the cut blade and the receiving blade are a back-to-back shape with an entry direction as a reference line.

According to the second disclosure of the invention, a corner cut•punch apparatus includes a transport path for transporting a sheet to enter into the transport path in a crossing direction so as to cut corners of the sheet and punch a hole in the sheet, and is provided with a support frame including a cut blade for cutting corners of the sheet in an inclined or curved manner, and a cut receiving blade for receiving the cut blade, and a drive section that causes the support frame to enter and retract into/from the transport path, where a punch blade for punching a hole in the sheet and a punch receiving blade for receiving the punch blade are disposed in the support frame.

Further, according to the third disclosure, a sheet corner cut•punch method, in a corner cut•punch apparatus comprised of a transport path for transporting a sheet, a support frame capable of entering and retracting into/from the transport path in a direction crossing a transport direction of a transported sheet, a cut blade attached to the support frame to cut corners of the sheet in an inclined or curved manner, and a punch blade that is provided in the support frame while being adjacent to the cut blade and that punches a punch hole in the sheet, includes:

- a waiting step of shifting the support frame to the transport path to wait for arrival of a sheet;
- a lead edge cut step of halting the sheet after the sheet arrives, and cutting corners on the lead edge side of the sheet;
- an end edge cut step of transporting the sheet to the downstream side after cutting corners on the lead edge side of the sheet, and halting the sheet to cut corners on the end edge side of the sheet;
- a punching step of transporting the sheet after cutting corners on the end edge side of the sheet, halting the sheet, shifting the support frame in the direction crossing the transport direction of the sheet, and punching a punch hole in a predetermined position of the sheet; and
- a discharge step of discharging the sheet after punching the punch hole in the sheet.

Furthermore, according to the fourth disclosure, a sheet corner cut•punch method, in a corner cut•punch apparatus comprised of a transport path for transporting a sheet, a support frame capable of entering and retracting into/from the transport path in a direction crossing a transport direction of a transported sheet, a cut blade attached to the support frame to cut corners of a sheet in an inclined or curved manner, and a punch blade that is provided in the support frame while being adjacent to the cut blade and that punches a punch hole in the sheet, includes:

- a sheet carry-in step of halting a sheet in a designated position of the transport path;
- a lead edge cut step of shifting the support frame, and cutting corners on the lead edge side of the sheet with the cut blade;
- a punching step of transporting the sheet after cutting corners on the lead edge side of the sheet, halting the sheet, shifting in the direction crossing the transport direction of the sheet, and punching a punch hole in a predetermined position of the sheet;
- an end edge cut step of transporting the sheet to the downstream side again after punching the punch hole in the sheet, halting the sheet, and cutting corners on the end edge side of the sheet; and
- a discharge step of discharging the sheet with corners on the end edge side cut.

Then, according to the fifth disclosure, a sheet corner cut•punch method, in a corner cut•punch apparatus comprised of a transport path for transporting a sheet, a support frame capable of entering and retracting into/from the transport path in a direction crossing a transport direction of a transported sheet, a cut blade attached to the support frame to cut corners of a sheet in an inclined or curved manner, and a punch blade that is provided in the support frame while being adjacent to the cut blade and that punches a punch hole in the sheet, includes:

- a waiting step of shifting the support frame to the transport path to wait for arrival of a sheet;
- a lead edge cut step of halting the sheet after the sheet arrives, and cutting corners on the lead edge side of the sheet;
- a punching step of transporting the sheet after cutting corners on the lead edge side of the sheet, halting the sheet, shifting in the direction crossing the transport direction of the sheet, and punching a punch hole in a predetermined position of the sheet;
- an end edge cut step of once transporting the sheet backward after punching the punch hole in the sheet, halting the sheet, and cutting corners on the end edge side of the sheet; and
- a discharge step of discharging the sheet with corners on the end edge side of the sheet cut.

BRIEF DESCRIPTION OF THE DRAWINGS

FIG. 15A illustrates a state for performing embossing on the apparatus rear side, and FIG. 15B illustrates a state for performing embossing on the front side of the apparatus;

FIG. 18A illustrates a sheet where both corner portions at the lead and end edges of the sheet are subjected to corner cuts, embossing and punching, FIG. 18B illustrates a sheet with cuts in a curved shape further made in the aforementioned sheet by the cut blade in edge portions of the sheet center in the width direction, and FIG. 18C illustrates a sheet with cuts in a curved shape made by the cut blade in edge portions in the width direction of folds in folding the sheet of FIG. 18A in three;

FIG. 19A illustrates an arrangement where substantial centers of the cut blade•punch blade•emboss section are in line in the sheet width direction, and FIG. 19B illustrates an arrangement where the punch blade is displaced to the downstream side in the sheet transport direction with respect to the cut blade and emboss section;

FIG. 20A illustrates an arrangement in which the punch blade is disposed while being displaced on the downstream side of a single four-corner cut blade, and FIG. 20B illustrates an arrangement in which the cut blade is divided in the center, and is disposed while overlapping the downstream-side punch blade;

DESCRIPTION OF THE EMBODIMENTS

Referring to drawings, described below are a sheet processing apparatus B including a corner cut•punch unit 30 as a corner cut apparatus (corner cut•punch apparatus) according to the present invention, and an image formation apparatus A to attach the apparatus B.

Figure 1:
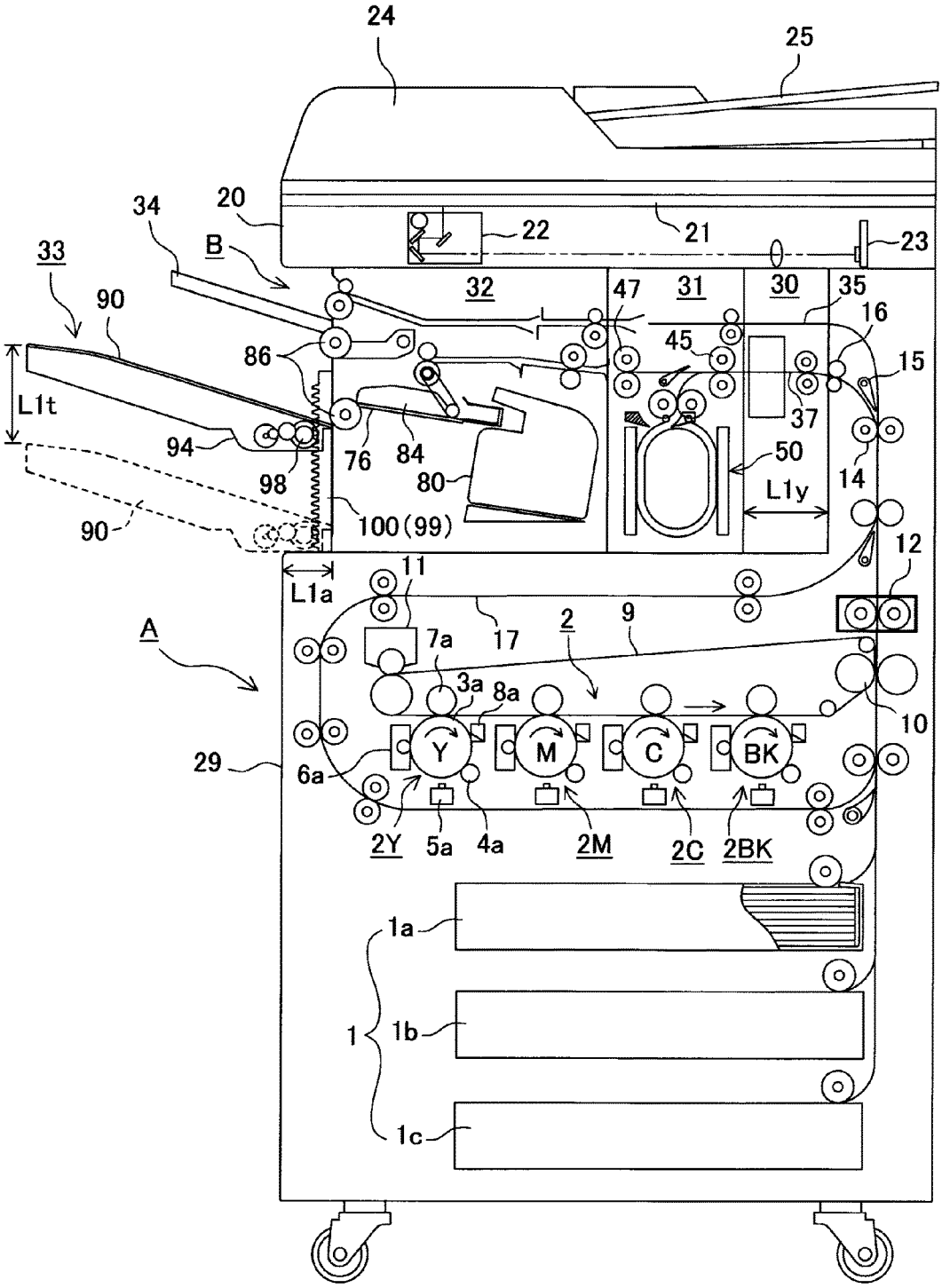
FIG. 1 is an explanatory view illustrating an entire configuration obtained by combining a corner cut•punch unit that is a corner cut•punch apparatus as a part of a sheet processing apparatus according to the present invention, and an image formation apparatus.
Figure 2:
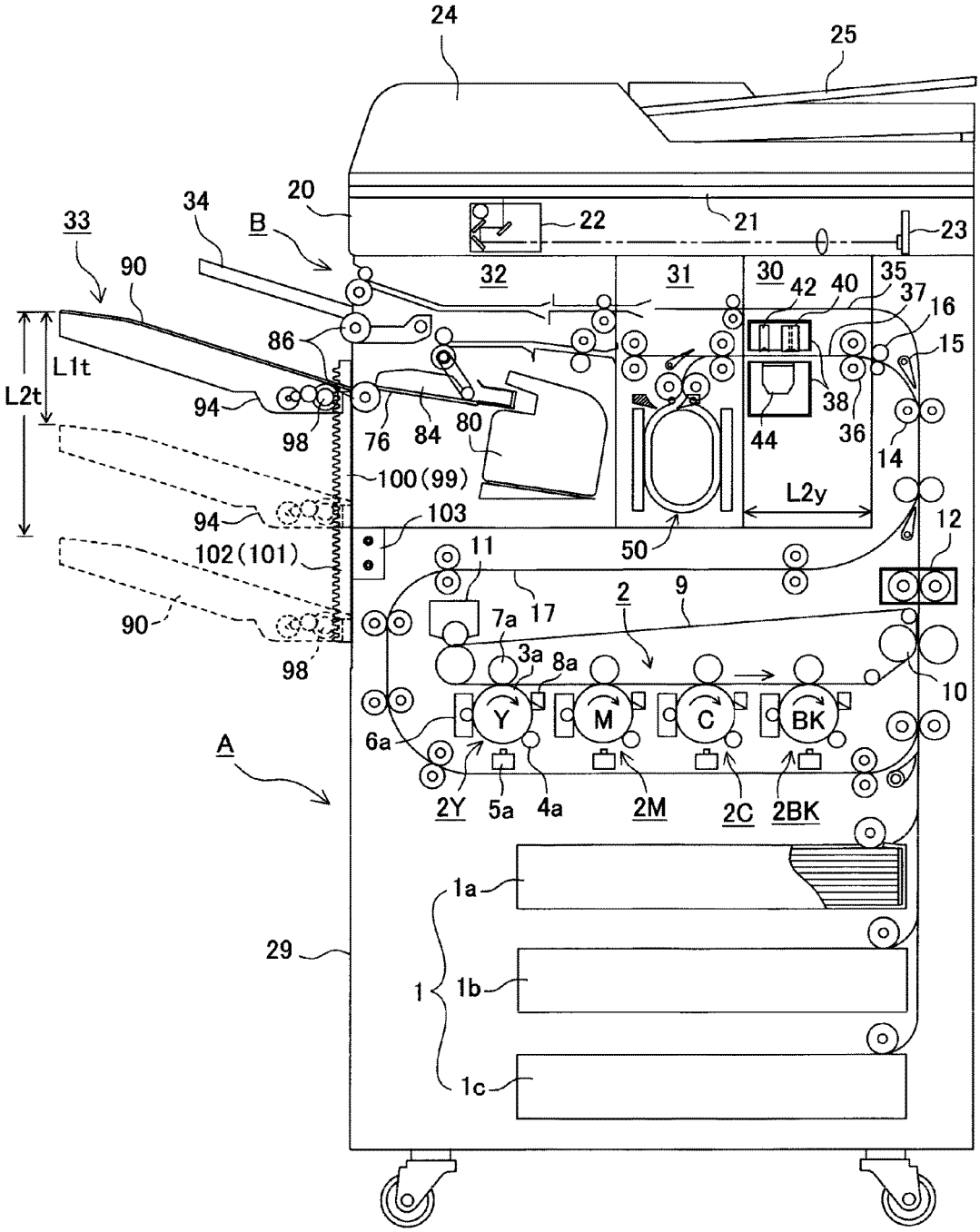
FIG. 2 is an explanatory view illustrating an entire configuration obtained by combining the corner cut•punch unit according to the present invention, a tray unit with an up-and-down extended, and the image formation apparatus.

FIG. 1 is an explanatory view illustrating an entire configuration of the sheet processing apparatus B including the corner cut•punch unit 30 according to the present invention, and the image formation apparatus A. FIG. 2 is an explanatory view illustrating an entire configuration obtained by combining the sheet processing apparatus B having the corner cut•punch unit 30 according to the invention with an up-and-down range of a collection tray 90 extended and the image formation apparatus A.

[Image Formation Apparatus A]

The image formation apparatus A shown in FIGS. 1 and 2 uses an electrophotographic scheme, and a paper feed section comprised of three-stage paper feed cassettes 1*a*, 1*b*, 1*c* to store sheets is disposed below an image formation section 2. When the sheet processing apparatus B is not inserted, space above the image formation section 2 is sheet discharge space, and an image reading apparatus 20 is disposed above the space. Accordingly, when the sheet processing apparatus B is disposed, as shown in the figure, the apparatus is the so-called in-body type using the sheet discharge space.

The image formation section 2 adopts a tandem scheme using an intermediate transfer belt. In other words, color components of four colors (yellow 2Y, magenta 2M, cyan 2C and black 2BK) are used. For example, in yellow 2Y, the section 2 has a photoconductor drum 3*a* as an image support body, a charging apparatus 4*a* comprised of a charging roller that charges the photoconductor drum 3*a*, and an exposure apparatus 5*a* that makes an image signal read with the image reading apparatus 20 a latent image. Further, the section 2 is provided with a development apparatus 6*a* that forms the latent image formed on the photoconductor drum 3*a* as a toner image, and a first transfer roller 7*a* that first-transfers the image on the photoconductor drum 3*a* formed by the development apparatus 6*a* to an intermediate transfer belt 9. This configuration is first-transferred to the intermediate transfer belt for each color component. The color component left on the photoconductor drum 3*a* is collected by a photoconductor cleaner 8*a* to prepare for next image formation. These schemes are the same as in the other color components as shown in FIGS. 1 and 2.

In addition, an image of the intermediate transfer belt 9 is transferred to a sheet fed from the paper feed section 1 by a second-transfer roller 10, and the image is fused to the sheet by pressurized force and heat by a fusing apparatus 12. The remaining superimposed color components on the intermediate transfer belt 9 are removed by an intermediate belt cleaner 11 to prepare for next transfer.

Thus image-formed sheet is fed to a main-body discharge roller 16 by a main-body relay roller 14. When image formation is performed on both sides of a sheet, the sheet once transported to the sheet processing apparatus B side with a switch gate 15 is switched back, transported to a circulation path 17, and is fed to the image formation section 2 again to form an image on the backside of the sheet.

The sheet with the image thus formed on one side or both sides is transported to the sheet processing apparatus B including the folding unit 31 via the main-body discharge roller 16.

In addition, the image reading apparatus 20 is disposed above the sheet discharge space above the image formation section 2. Herein, an original document placed on an original document stacker 25 is fed to platen 21 with an original document feeding apparatus 24, the fed original document is sequentially read with a photoelectric converter (for example, CCD) by irradiating using a scan unit 22, and the image is stored in a data storage section not shown. The stored image is formed on the sheet in the image formation section as described above.

[Sheet Processing Apparatus B]

Described next is the sheet processing apparatus B disposed in the sheet discharge space below the image reading apparatus 20, above the image formation section 2 of FIGS. 1 and 2. As a part of the sheet processing apparatus B, the corner cut•punch unit 30 is provided as a corner cut apparatus or corner cut•punch apparatus which cuts corners of a sheet, and when necessary, punches a punch hole according to the invention.

In the sheet processing apparatus B is disposed the corner cut•punch unit 30 which guides a sheet to switch back so as to form images on both sides of the sheet discharged from the main-body discharge roller 16, and feeds the sheet to the downstream side, while cutting corners of the sheet, punching a punch hole, or adding a mark with a stamp or embossing.

On the downstream side of the corner cut•punch unit 30 are disposed the folding unit 31 for folding a sheet, for example, in three, a binding unit 32 for temporarily placing sequentially transported image-formed sheets on a processing tray 76 as a bunch to bind with a stapler 80, and a tray unit 33 having a collection tray 90 for collecting bunches of sheets bound by the binding unit 32 and sheets discharged without being bound and moving up and down.

In addition, the corner cut•punch unit 30 constituting the sheet processing apparatus B also acts as a guide unit for extending a range of the sheet processing apparatus. Further, the corner cut•punch unit 30, folding unit 31, and binding unit 32 having the tray unit 33 are capable of being disposed selectively, and for example, it is possible to place or omit only the binding unit 32 and/or corner cut•punch unit 30.

In addition, in the tray unit 33 having the collection tray 90 that moves up and down, in FIG. 1, the collection tray 90 moves up and down with respect to an up-and-down rack 100, while the binding unit 32 is in a position on the inner side corresponding to L1*a* from a stay of an apparatus frame 29 of the image formation apparatus A. Accordingly, since the sheet processing apparatus B is disposed in the sheet discharge space, the entire image formation apparatus A is made compact. Therefore, for example, when only the binding unit 32 is placed in the sheet discharge space, the collection tray 90 that moves up and down is also positioned in the sheet discharge space, and it is thereby possible to make the apparatus more compact.

On the other hand, in the apparatus shown in FIG. 1 in this case, a shift range in which the collection tray 90 moves up and down is a range of L1*t* range up to the upper surface of the apparatus frame 29. Generally, this L1*t* range is set at about 500 sheets to 1000 sheets as a collection amount of sheets, and in the case where sheets exceed the amount, the image formation apparatus A is halted to remove sheets placed on the collection tray 90 or to replace with a completely different sheet processing apparatus B capable of being externally installed on the apparatus frame 29.

Therefore, in the collection tray 90, an extension rack 102 capable of extending the up-and-down range with ease is added to the conventional up-and-down rack 100 (up-and-down rail 99), and FIG. 2 illustrates the sheet processing apparatus B that increases a sheet collection amount on the collection tray 90 and the image formation apparatus. By adding the extension rack 102 (extension rail 101), it is possible to increase the collection amount of sheets by about 500 sheets to 1000 sheets.

In order to arrange in this way, for the corner cut•punch unit 30 according to the invention, two types are prepared including the unit with a relatively short length (L1*y*) shown in FIG. 1, and the unit with a longer length (L2*y*) than L1*y* shown in FIG. 2. In other words, in order to add the extension rack 102 and enable the collection tray 90 to shift downward to the extension rack 102, first, the corner cut•punch unit 30 having the length of L1*y* in the transport direction in FIG. 1 is replaced with the corner cut•punch unit 30 having the length of L2*y* in the transport direction in FIG. 2. The length of L2*y* herein is to eliminate the distance L1*a* between the binding apparatus side surface and the side surface of the apparatus frame 29 in FIG. 1 and make a position in which the up-and-down rack 100 and the extension rail 101 are connected.

Summaries will be described below, in regard to the corner cut•punch unit 30, folding unit 31, binding unit 32, tray unit 33 installed in the unit 32, an up-and-down mechanism of the collection tray 90 of the tray unit 33, and the extension rail including the extension rack 102 that extends the up-and-down range constituting the sheet processing apparatus B.

[Corner Cut•Punch Unit 30]

Figure 3:
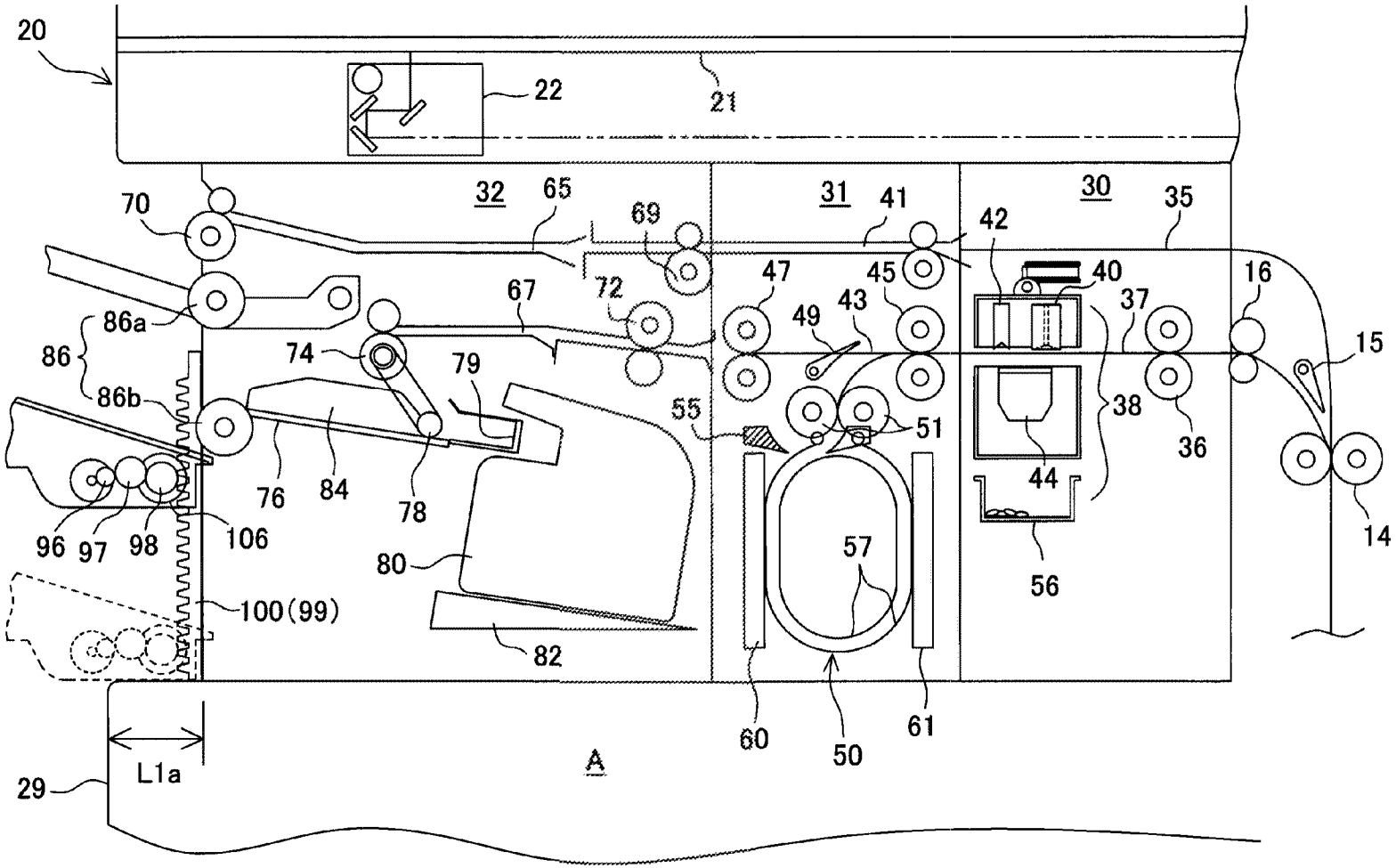
FIG. 3 is an explanatory view illustrating the sheet processing apparatus including the corner cut•punch unit shown in FIG. 1.

As shown in FIGS. 1 to 3, the corner cut•punch unit 30 according to the present invention is disposed immediately after a main-body discharge outlet 3. The summary will be described herein, and details will be descried from FIG. 4. In an upper stage of the corner cut•punch unit 30 is provided a switchback path 35 for guiding a sheet undergoing switchback transport with the main-body relay roller 14.

Below the switchback path 35 is provided a transport path 37 for transporting a sheet from the main-body discharge roller 16 to the downstream side. Then, support frames 38 are provided with cut blades 40 for shifting to enter and retract into/from the transport path 37 of a sheet in a direction crossing a transport direction and cutting corners of a sheet in an inclined or curved manner, and adjacent punch blades immediately after the cut blades 40 for punching punch holes in the sheet. Further, on the side opposite to the side of the cut blade 40 and punch blade 42 with the transport path 37 therebetween, emboss sections 44 for adding a concavo-convex pattern to the sheet are disposed in the same support frames 38, and each of these members is configured to shift up and down with respect to the sheet surface. In addition, in FIG. 3, a box type waste basket 56 for storing cut scraps and punch scarps is also attached to the unit to be attachable/detachable.

[Folding Unit 31]

FIG. 3 is an enlarged explanatory view of the folding unit 31, binding unit 32 and tray unit 33 installed in the unit 32 constituting a part of the sheet processing apparatus B of FIG. 1. The sheet processing apparatus Bin FIG. 2 is the same as in FIG. 3 except extension of the shift range of the collection tray 90.

First, among paths continued to the switchback path 35 and transport path 37 of the corner cut•punch unit 30 from the main-body discharge outlet 16, in a folding transport path 43 in the lower stage are disposed entrance rollers 45 and exit rollers 47. A switching flapper 49 is provided between the entrance roller 45 and the exit roller 47, and by the switching flapper 49, it is configured that folding processing is performed in a substantially cylindrical shape folding section 50 without transporting a sheet to the subsequent binding unit 32. In addition, in the upper stage is provided a folding switchback path 41 connected to the switchback path 35 of the corner cut•punch unit 30 shown in FIGS. 1 to 3.

The substantially cylindrical shape folding section 50 enables carry-in rollers 51 that are transport rollers of the present invention and that carry a sheet in the substantially cylindrical shape folding section 50, and first gates 53 and second gates 55 that determine a winding direction of a sheet with respect to the substantially cylindrical shape folding section to shift to actuation positions selectively. For example, by the first gate 53, a sheet is wound around a substantially cylindrical shape formation section 57 in a substantially cylindrical shape in a counterclockwise direction as viewed in the figure. The substantially cylindrical shape formation section 57 is formed of a deformable sheet member, and winds a sheet, for example, in a state in which three faces are overlapped in a substantially cylindrical shape. Then, in the state where the sheet is wound around the substantially cylindrical shape formation section, when shift members 60, 61 positioned on the opposite sides shift in mutually approaching directions by link members 62, 63 shown in FIG. 4, the wound sheet is also made a vertically flat shape of elliptical cross section. Further, by push-out members 60*e*, 61*e* of the link members 62, 63, the sheet shifts to between cylindrical folding rollers 64 in FIG. 4. Subsequently, by pulling out the wound sheet made a flat shape by press-contact rotation of the folding rollers 64, the folded sheet is obtained.

[Binding Unit 32]

Successively, the binding unit 32 will be described which binds sheets transported from the folding unit 31, without performing folding processing in the folding unit 31 in FIGS. 1 to 3. As shown in FIG. 3 specifically, also in the binding unit 32, in the upper stage is provided a binding switchback path 65 connected to the folding switchback path 41, a transport roller 69 is disposed on the entrance side, and a discharge roller 70 is disposed on the exit side. The binding switchback path 65 functions as a path for switching back to the image formation section 2 to form an image on the backside, and when necessary, is also capable of discharging a sheet such as a thick sheet unsuitable for both sides or binding processing to an escape tray 34 positioned above the tray unit 33 with the discharge roller 70. In addition, as the switchback path 35, folding switchback path 41 and binding switchback path 65, an upper cover of each unit may be used for the path for switchback.

Below the binding switchback path 65 is provided a binding transport path 67 connected to the folding transport path 43 of the folding unit 31. On the entrance side of the binding transport path 67 are provided a binding carry-in roller 72 and carrying-out roller 74 for discharging a sheet to the processing tray 76 or collection tray 90. When the sheet discharged from the carrying-out roller 74 is temporarily placed on the processing tray 76 as a bunch, a bunch discharge roller 86 that also functions for discharge of a bunch is rotated in a counterclockwise direction (direction of a reference surface 79) in a state of nipping the sheet, a take-in roller 78 that rotates in a counterclockwise direction in cooperation with the roller 78 is rotated, and the sheet is transported until the sheet comes into contact with the reference surface 79. Concurrently therewith, a pair of alignment plates 84 positioned in a sheet width direction of the processing tray 76 are brought into contact with the sheet side edges to align the sheet.

This operation is repeated until the number of sheets reaches the number of binding sheets, and when reaching the number of binding sheets, at this point, the stapler 80 is shifted to a predetermined position of a shift bench 82 to perform binding processing. A bunch of sheets with a designated portion subjected to the binding processing by the stapler 80 is discharged to the collection tray 90 by shifting the reference surface 79 not shown to the collection tray 90 side, and bringing an up-and-down bunch discharge roller 86*a* into press-contact with a lower bunch discharge roller 86*b* received on the discharge side of the processing tray 79.

[Tray Unit 33]

A bunch of sheets or each sheet discharged by the bunch discharge roller 86 is collected in the tray unit 33 having the collection tray 90 moving up and down. The collection tray 90 moves up and down by up-and-down pinions 98 of the collection tray 90 rotation-engaging in up-and-down racks 100 constituting a part of up-and-down rails 99 that are shift rails described later. The up-and-down pinion 98 is driven by an up-and-down motor 95 positioned in an up-and-down motor installation portion 94 below the collection tray 90 via a transmission gear 97 and the like.

As described already, the range of up-and-down of the collection tray 90 shown in FIG. 3 is the L1*t* range, because the sheet processing apparatus B including the binding unit 32 is positioned inside the body corresponding to L1*a* from the side portion of the apparatus frame 29. Then, by providing the extension rail 101 shown in FIG. 2, it is possible to extend the up-and-down range of the collection tray 90, and it is possible to increase a collection amount of sheets. In addition, the extension rail 101 is attached by an extension rail attachment portion 103 to be accepted in the apparatus frame 29 of the image formation apparatus A and the sheet processing apparatus B.

Figure 4:
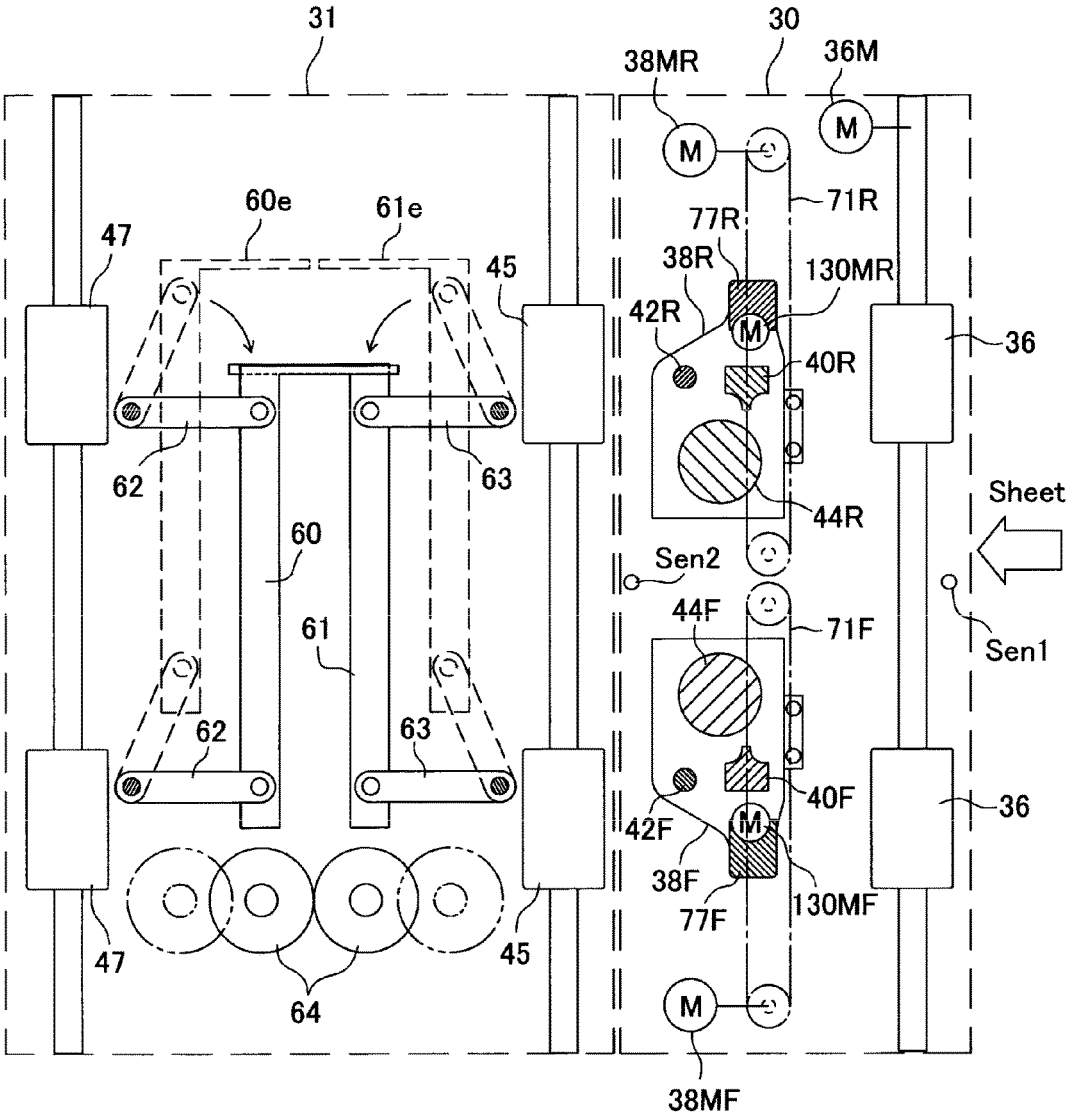
FIG. 4 is a plan view illustrating a principal part inside the corner cut•punch unit and folding unit of FIG. 3.
Figure 5:
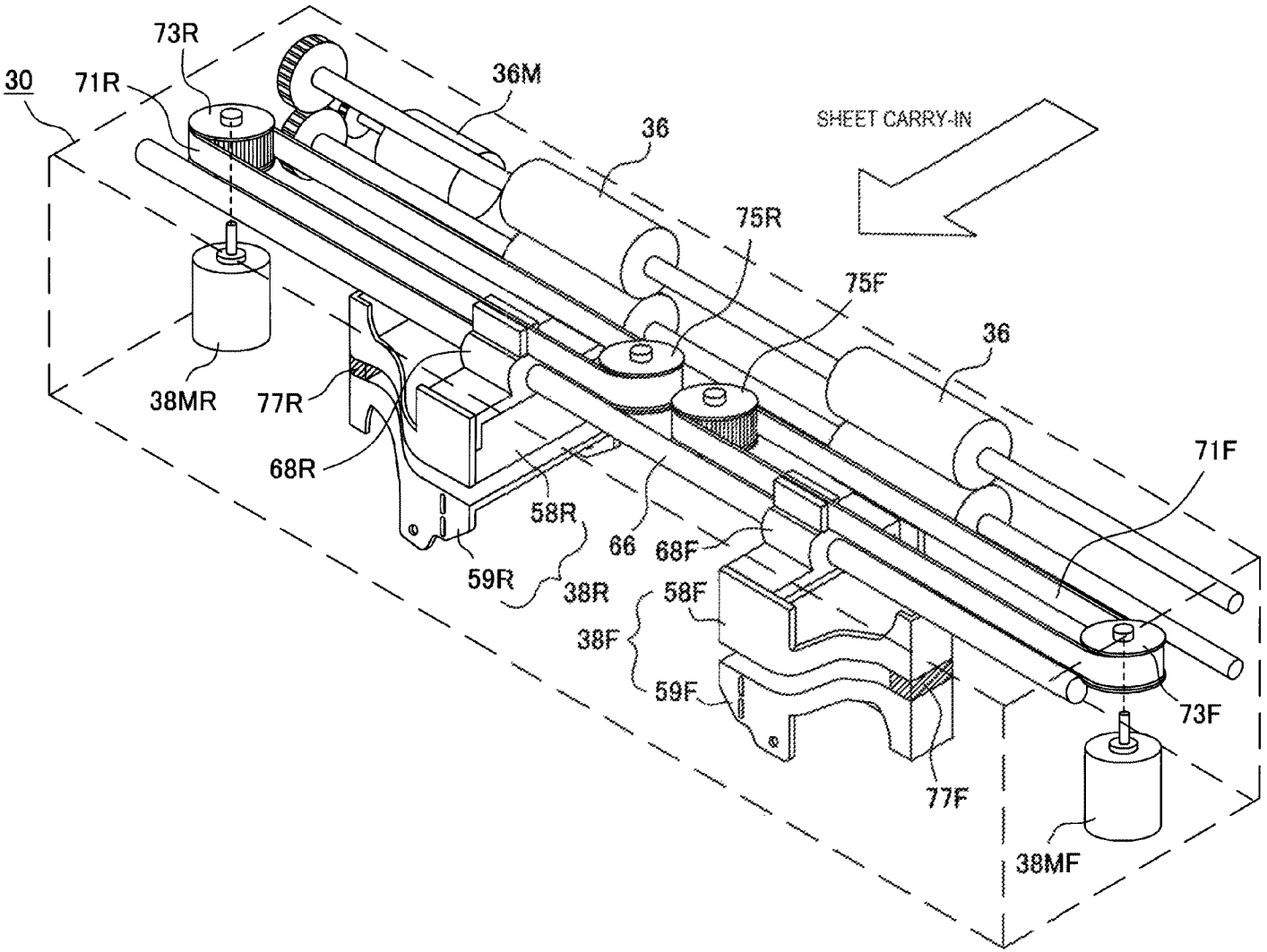
FIG. 5 is a perspective view of the corner cut•punch unit of FIG. 4.
Figure 6:
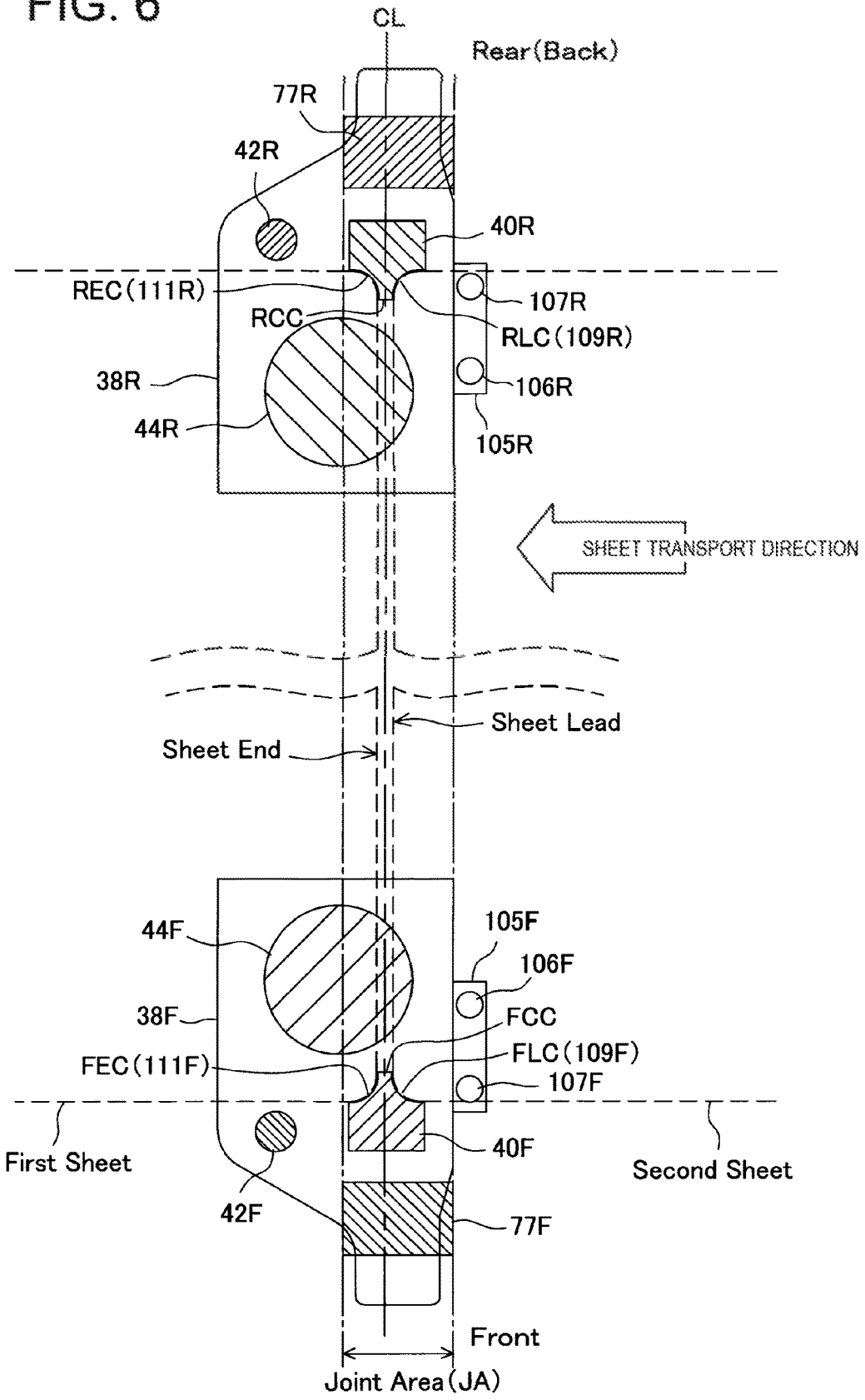
FIG. 6 is a plan explanatory view illustrating the relationship between the corner cut•punch unit of FIGS. 4 and 5 and sheets.

Hereinafter, the corner cut•punch unit 30 as the corner cut apparatus (corner cut•punch apparatus) according to the present invention constituting a part of the sheet processing apparatus B will specifically be described, with reference to FIGS. 4 to 13. FIG. 4 is a plan view of the corner cut•punch unit 30 disposed between the folding unit 31 and the image formation apparatus A. FIG. 5 is a perspective view of the corner cut•punch unit 30, and FIG. 6 is a view to explain the relationship between the support frame 38 and sheets. Further, FIGS. 7 to 13 are explanatory views of respective mechanisms.

In addition, in the following description, the front side is represented by F, the rear side is represented by R, and the description is made by adding F or R to the last of a reference numeral representing the component/configuration. For example, it is assumed that a support frame 38F indicates the support frame on the front side, and that a support frame 38R indicates the support frame on the rear side. Further, for a common component/configuration originally on the front side or the rear side, in order to simplify the description, there is a case where notation of F or R is omitted.

[Sheet-Width Direction Shift of the Support Fame 38]

FIG. 4 is a plan explanatory view, and the corner cut•punch unit 30 will be described also with reference to FIGS. 5 and 6. The support frames 38 that support the cut blades 40, punch blades 42, and emboss sections 44 are provided opposite as a pair on the front side that is the front side of the apparatus, and on the rear side at the back. In other words, the front-side support frame 38F supports a front-side cut blade 40F, front-side punch blade 42F, front-side emboss section 44F, front-side frame motor 38MF for shifting the blades and section, and a front-side sheet sensor 105F on the sheet carry-in side. Then, between pulleys is laid a front-side shift belt 71F for shifting the front-side support frame 38F to enter/retract in a direction (entry direction) crossing the sheet transport direction. As shown in FIG. 5 specifically, the front-side shift belt 71F shifts in the sheet center direction and in the direction separating from the center by the front-side frame motor 38MF.

Further, the rear side is of the same configuration, and the rear-side support frame 38R supports a rear-side cut blade 40R, rear-side punch blade 42R, rear-side emboss section 44R, rear-side frame motor 38MF for shifting the blades and section, and a rear-side sheet sensor 105R on the sheet carry-in side. Then, between pulleys is laid a rear-side shift belt 71R for shifting the rear-side support frame 38R to enter/retract in the direction (entry direction) crossing the sheet transport direction. As shown in FIG. 5 specifically, the rear-side shift belt 71R shifts in the sheet center direction and in the direction separating from the center by the rear-side frame motor 38MR.

On the sheet carry-in side of the corner cut•punch unit 30, cut section carry-in rollers 36 for taking a sheet into the unit to transport are provided to be driven to rotate by a carry-in roller drive motor 36M. FIG. 5 is a perspective view of the corner cut•punch unit 30 of the FIG. 4, and it is understood that the front-side support frame 38F is configured by joining and fixing a front-side cut blade frame 58F and front-side receiving blade frame 59F by a front side joint portion 77 with distance space provided.

To the front-side support frame 38F is fixed a front-side slide guide 68F, and the front-side slide guide 68F is fixed to the front-side shift belt 71F laid between a front-side shift belt pulley 73F and a front-side driven pulley 75F. The front-side slide guide 68F slides on a guide rot 66 from side to side as viewed in the figure. By this means, the front-side shift belt 71F reciprocates by forward/backward rotation of the front-side frame motor 38MF, and the front-side support frame 38F is configured to also enter and retract with respect to a sheet.

On the other hand, to the rear-side support frame 38R is also fixed a rear-side slide guide 68R, and the rear-side slide guide 68R is fixed to the rear-side shift belt 71R laid between a rear-side shift belt pulley 73R and a rear-side driven pulley 75R. The rear-side slide guide 68R slides on the guide rot 66 from side to side as viewed in the figure. By this means, the rear-side shift belt 71R reciprocates by forward/backward rotation of the rear-side frame motor 38MR, and the rear-side support frame 38R is configured to also enter and retract with respect to a sheet.

[Relationship between the Support Frame 38 and Sheets]

Referring to FIG. 6, described next is the relationship between the support frame 38 and cuts of corners of sheets by the cut blade 40 with emphasis thereon. Cuts of corners, addition of embossing, and punching of punch holes corresponding to transport of a sheet will be described from FIG. 14.

As described already, the front-side support frame 38F and rear-side support frame 38R are disposed opposite each other in the direction crossing the transport direction of the sheet. Onto the front-side support frame 38 is fixed and provided the front-side sheet sensor 105F to detect the front-side lead edge and front-side side edge of the sheet.

[Sheet Sensor 105 of the Support Frame 38]

Further, on the front-side sheet sensor 105 are provided two sensors including a front-side sheet lead/end edge sensor 106F for first detecting arrival of a sheet when the front-side support frame 38F shifts near the center of the sheet corresponding to the size of the sheet in the width direction, and a front-side sheet side edge sensor 107F for detecting the side edge on the front side of the sheet in further shifting near the center after detecting the lead edge. Then, the front-side sheet side edge sensor 107 shifts near the center of the sheet, and it is configured that a position for detecting the side edge of the sheet on the front side coincides with a front-side lead edge cut (FLC) position of the sheet. Accordingly, as shown in FIG. 6, it is possible to form the front-side lead edge of the sheet in a convex curved shape.

Further, the rear-side support frame 38R has also the completely same configuration except the opposite arrangement in the shift direction, the description herein is thereby omitted, and the frame 38R is capable of forming the rear-side lead edge of the sheet in a convex curved shape. Further, by the front-side sheet lead/end edge sensor 106F and rear-side sheet lead/end edge sensor 106R, it is also possible to detect whether the sheet is transported while being skewed.

By this means, for example, when the corner of the sheet arrives at the front-side support frame 38F earlier, only the front-side cut blade 40F is first operated to form the front-side lead edge cut FLC. After transporting the sheet slightly so that the corner on the rear side of the sheet is in a corner cut proper position of the rear-side support frame 38R, at this point, the rear-side cut blade 40R is configured to operate. By this means, even when the sheet is transported, while being skewed within an allowable range, the corner cut is not displaced. This operation is achieved by that the support frame 38 and cut blade 40 are disposed opposite and are capable of being driven independently.

In addition, the skew of a sheet is judged by determining the time of arrival of the front-side lead edge and rear-side lead edge of the sheet. When the skew exceeds the limit of the allowable range, it is assumed that it is not possible to cut corners, and the apparatus may be halted or an alarm may be issued to a user.

Further, also for the end edge of the sheet, since the cut range by the same cut blade 40 is configured to be back-to-back with respect to a line parallel with the entry direction passing through the center of the cut blade 40, it is possible to make the front-side end edge cut (FEC) and rear-side end edge cut (REC). Further, the front-side punch blade 42F is provided in the front-side support frame 38F, the rear-side punch blade 42R is also provided in the rear-side support frame 38R, and this apparatus enables punch holes to be punched on the end edge side of the sheet.

[Joint Portion of the Support Frame 38]

In addition, as described already, the support frame 38 is configured by joining and fixing the cut blade frame 58 and receiving blade frame 59F by the joint portion 77 with predetermined distance space provided, and the joint portion 77 is positioned on the most outward side in the sheet width direction. Areas of the joint portion in the sheet width direction are shown by oblique lines in FIG. 6 as a joint area JA. On the inner side (close to the sheet width center) in the sheet width direction of this range, the cut blades 40 (front-side cut blade 40F, rear-side cut blade 40R) are positioned. Further, on the downstream side in the sheet transport direction of the joint area JA are positioned the punch blades 42 (front-side punch blade 42F, rear-side punch blade 42R). Accordingly, when a punch hole is punched, the support frames 38 (front-side support frame 38F, rear-side support frame 38R) are capable of shifting in the center direction of a sheet, without the joint portions colliding with the sheet.

Figure 11:
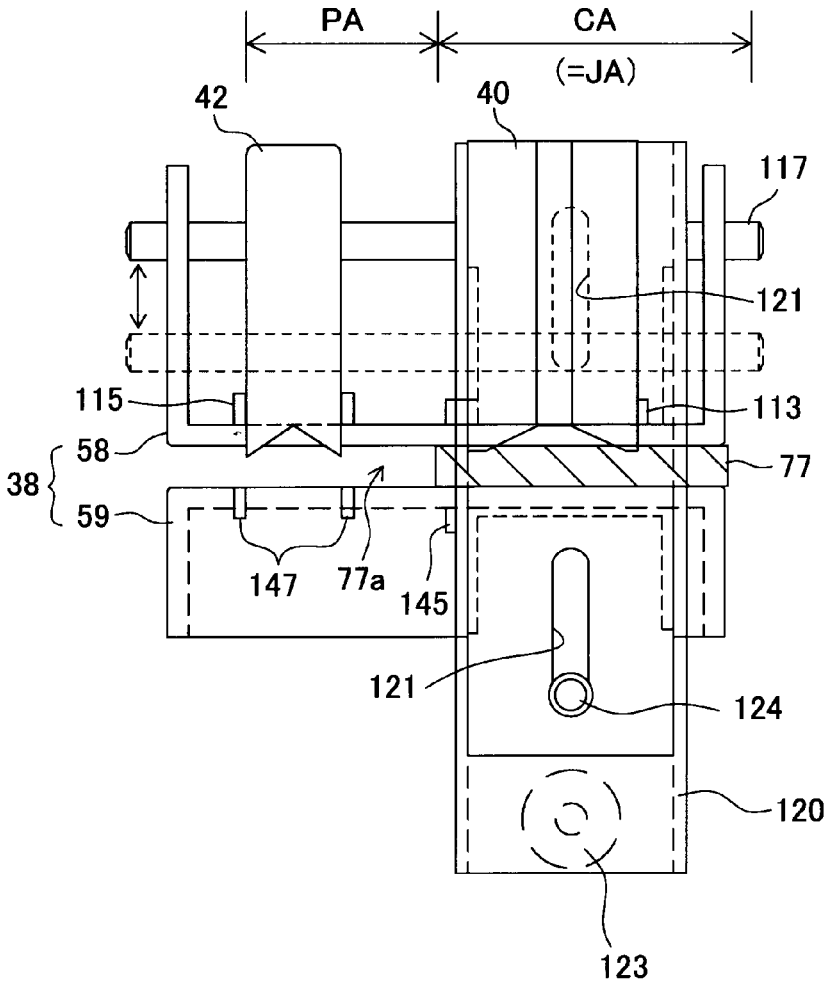
FIG. 11 is an enlarged explanatory view of the cut blade and punch blade.

In addition, on corners at the lead edge and end edge of the sheet in FIG. 6, when the sheet is cut with the lead edge cut blades 109 (109F, 109R) of the cut blade 40 shown in FIG. 11, the front-side lead edge cut FLC and rear-side lead edge cut RLC are formed in the sheet. Further, when the sheet is cut with the end edge cut blades 111 (111F, 111R) of the cut blade 40, the front-side end edge cut FEC and rear-side end edge cut REC are formed in the sheet.

Further, in the lead edge cut blades 109 (109F, 109R) and end edge cut blades 111 (111F, 111R) of the cut blade 40 shown in FIG. 11, the blades are formed in the mutually back-to-back relationship. In other words, more specifically, with the center line CL in the sheet transport direction of the cut blade 40 as a reference line, the lead edge cut blades 109 (109F, 109R) and end edge cut blades 111 (111F, 111R) are configured to be substantially line symmetrical. By configuring in this way, it is possible to cut both corners of each of the lead edge and end edge of sheets in a curved shape (convex R shape) as shown in the figure. This respect will be described again in corner cut and punch operation of a sheet.

In addition, in this Embodiment, both corners of each of the lead edge and end edge of the sheet are cut in a curved shape (convex R shape) as shown in the figure, and as well as the blade, a blade shape may be used to cut in an inclined shape or concave curved shape. It is essential only that the blade is capable of being configured back-to-back, more specifically, configured substantially line symmetrically with respect to the center line CL as a reference line.

Hereinafter, the configuration and components of the corner cut•punch unit 30 will be described with reference to FIGS. 7 to 13.

Figure 7:
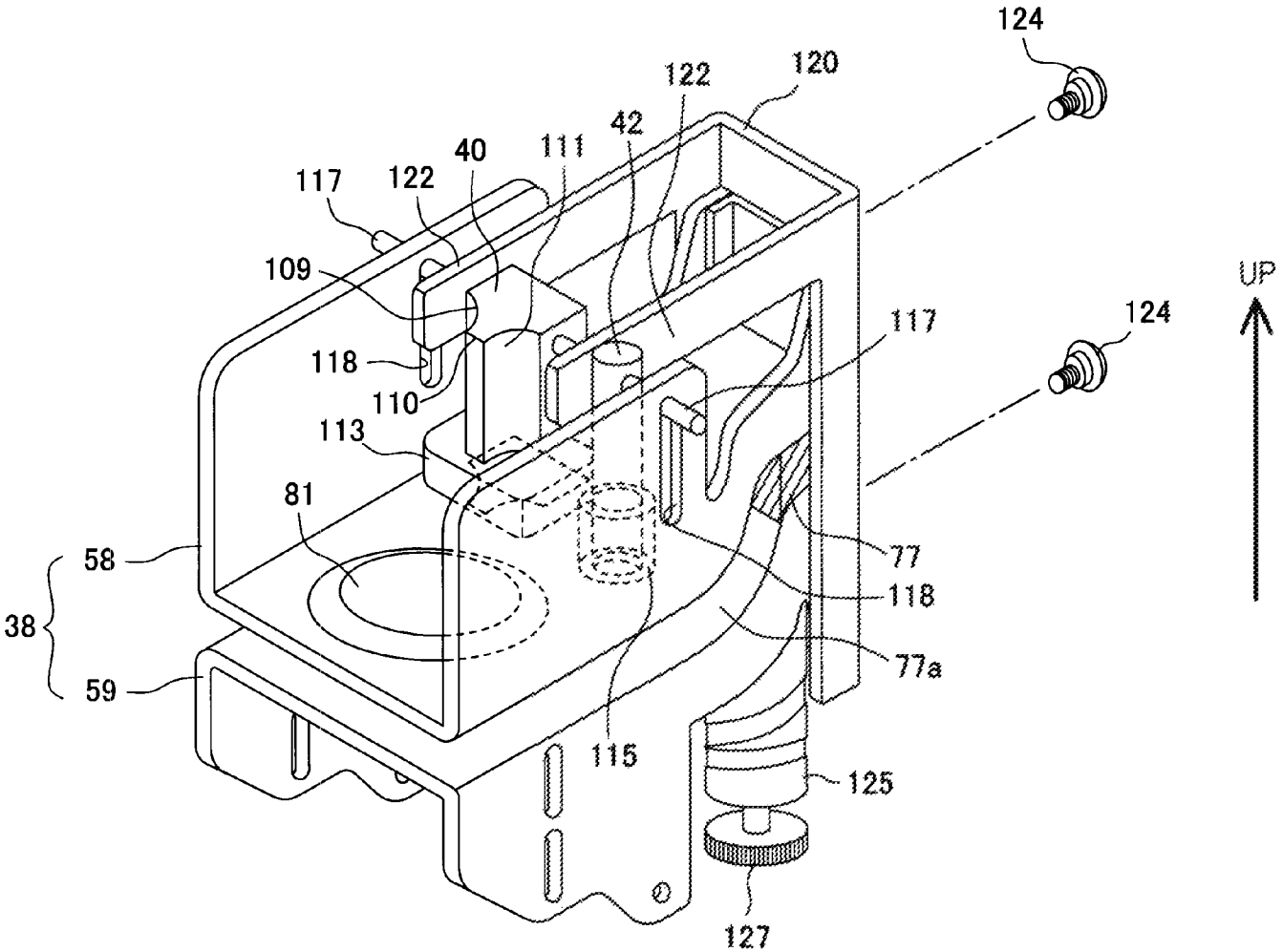
FIG. 7 is a perspective view from a cut blade frame side of the corner cut•punch unit.
Figure 8:
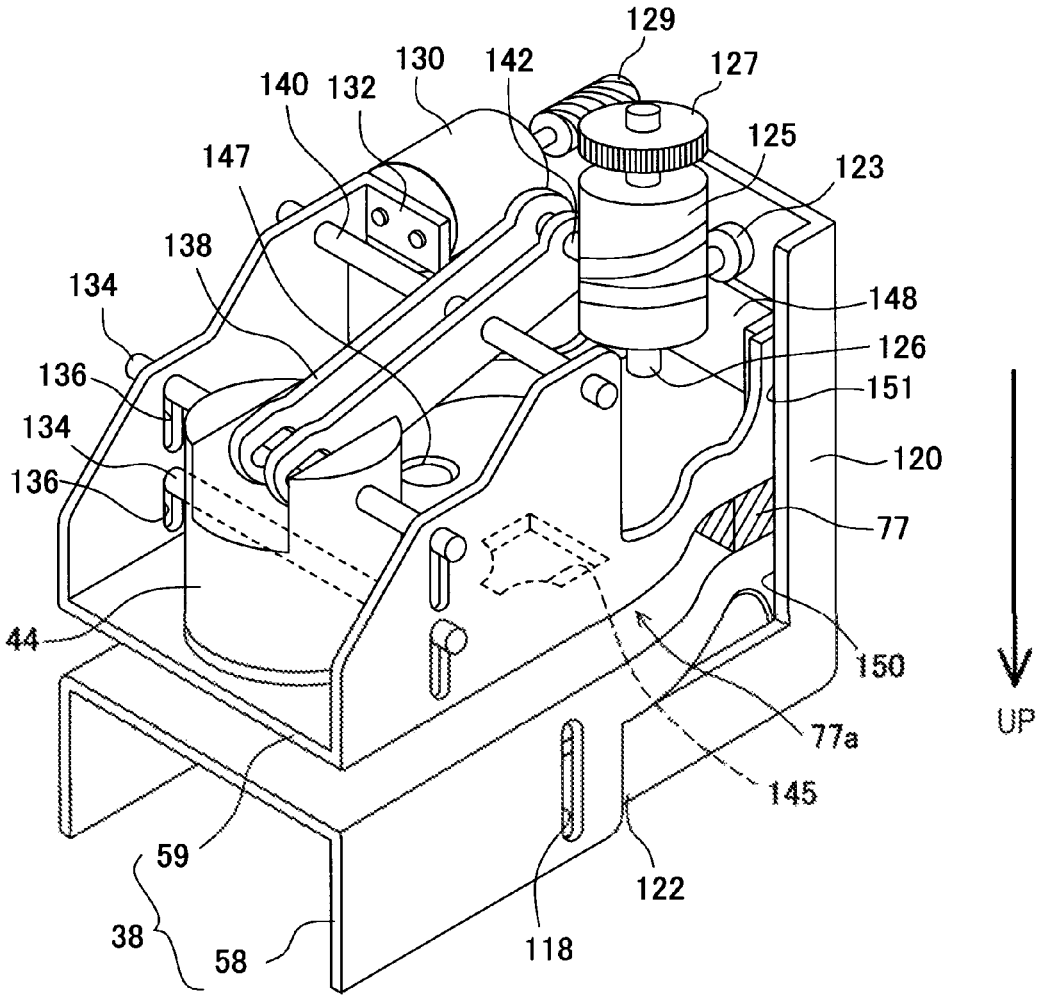
FIG. 8 is a perspective view from a receiving blade frame side of the corner cut•punch unit.

First, FIG. 7 is a perspective view from the cut blade frame 58 side, and FIG. 8 is a perspective view from the receiving blade frame 59 side. The support frame 38 is comprised of the cut blade frame 58 and receiving blade frame 59, and each of the cut blade frame 58 and the receiving blade frame 59 is made of a U-shaped sheet-metal member (channel member).

[With Regard to the Cut Blade Frame 58]

As shown in FIG. 7, in the cut blade frame 58 are disposed the cut blade 40 and punch blade 42, and a cut blade guide 113 and punch blade guide 115 for guiding ascent/descent of the blades are also disposed in the frame 58. Further, in a position on the inner side in the sheet width direction, an emboss receiver 81 is provided as a receiver of the emboss section 44.

The cut blade frame 58 is configured by narrowing so that the outside in the sheet width direction is narrow, and in an end portion thereof is provided a shift lever 120 that slides on the back side of the cut blade frame 58. In a shift lever front end 122 of the shift lever 120 is provided a shift bar 117 that penetrates the cut blade 40 and punch blade 42, and the shift bar 117 slides in shift bar guides 118 provided in the cut blade frame 58.

A lower end of the shift lever 120 engages in a cylindrical shift cam 125. By rotation of the shift cam 125, the shift lever 120 moves up and down (ascends/descends), and by this means, the cut blade 40 and punch blade 42 move down toward the receiving blade frame 59 to cut corners of a sheet and punch a punch hole. As can be seen from the figure, the cut blade 40 and punch blade shift up and down at the same timing by the shift lever 120, and are devised in a position relationship so that the cut blade 40 and punch blade do not act on a sheet concurrently in relation to the sheet. These schemes will be described later together with a shift of a sheet.

[With Regard to the Joint Portion 77]

In an end portion positioned outside the cut blade frame 58 in the sheet width direction, the joint portion 77 is provided to couple and join the receiving blade frame 59 with space of distance space 77*a* for enabling a sheet to be transported. The joint portion is to screw the cut blade frame 58 and receiving blade frame 59 to couple with a metal block body as a spacer, or may be to join the frames with a bending sheet metal provided therebetween, and it is essential only that frames of the cut blade frame 58 and receiving blade frame 59 are fixed and joined without misregistration so that the cut blade 40 and punch blade 42 penetrate the receiving frame 59 without displacement.

[With Regard to the Receiving Blade Frame 59]

The receiving blade frame 59 constituting the lower side of the support frame 38 will be described next with reference to FIG. 8. As shown in the figure, FIG. 8 is a perspective view obtained by flipping the support frame 38 of FIG. 7 and turning upside down. In the receiving blade frame 59 shown in the figure are disposed the emboss section 44 for forming concavities and convexities on a sheet to add a mark, the cut receiving blade 145, and the punch receiving blade 147. These members are arranged to support the emboss receiver 81, cut blade 40 and punch blade 42 of the cut blade frame 58, and particularly, the cut blade 40 and punch blade 42 are positioned so as to respectively insert into the cut receiving blade 145 and punch receiving blade 147.

Further, in the receiving blade frame 59 is disposed the cylindrical shift cam 125 that moves the emboss section 44, cut blade 40 and punch blade up and down. A cam support shaft 126 of the shift cam 125 is axially supported by the receiving blade frame 59. The transmission gear 127 side on the opposite side is also supported axially by the receiving blade frame 59, but is omitted for convenience in drawing. As in the shift cam 125, a shift motor 130 that rotates forward and backward via a worm gear 129 is also attached to a motor attachment portion 132 of the receiving blade frame 59.

[Shift Configuration of the Emboss Section 44]

The emboss section 44 is supported by two upper and lower emboss shift levers 134 that penetrate in the sheet transport direction. The emboss shift levers 134 are capable of sliding by upper and lower emboss shift lever guides 136 provided in the receiving blade frame 59. The emboss shift lever 134 is provided in rotating arms 138 that rotate about a rotating arm shaft 140 provided in the receiving blade frame 59, and a cam engagement portion 142 in the other end of the rotating arm 138 engages in the cylindrical shift cam 125.

Accordingly, when the shift cam 125 rotates, the rotating arm 138 moves up and down, and the emboss section 44 presses toward the emboss receiver 81 on the cut blade frame 58 side, and is capable of adding an embossed mark to a sheet. The cam engagement portion 142 engages (is fitted) in a cam groove of the shift cam 125 with a phase different from that of an engagement portion 123 of the shift lever 120 by about 90 degrees. The relationship among forward/backward rotation of the shift cam 125, shift lever 120 and rotating arm will be described with reference to FIG. 13. Further, a portion positioned outside the receiving blade frame 59 in the sheet width direction has a receiving blade frame slide portion 151 of the shift lever 120 that shifts up and down the cut blade 40 and punch blade 42 described previously, the cut blade frame 58 also has a cut blade frame slide portion 150, and the shift lever 120 shifts up and down along the portions.

[Arrangement of the Cut Blade 40, Punch Blade 42 and Emboss Section 44]

Figure 9:
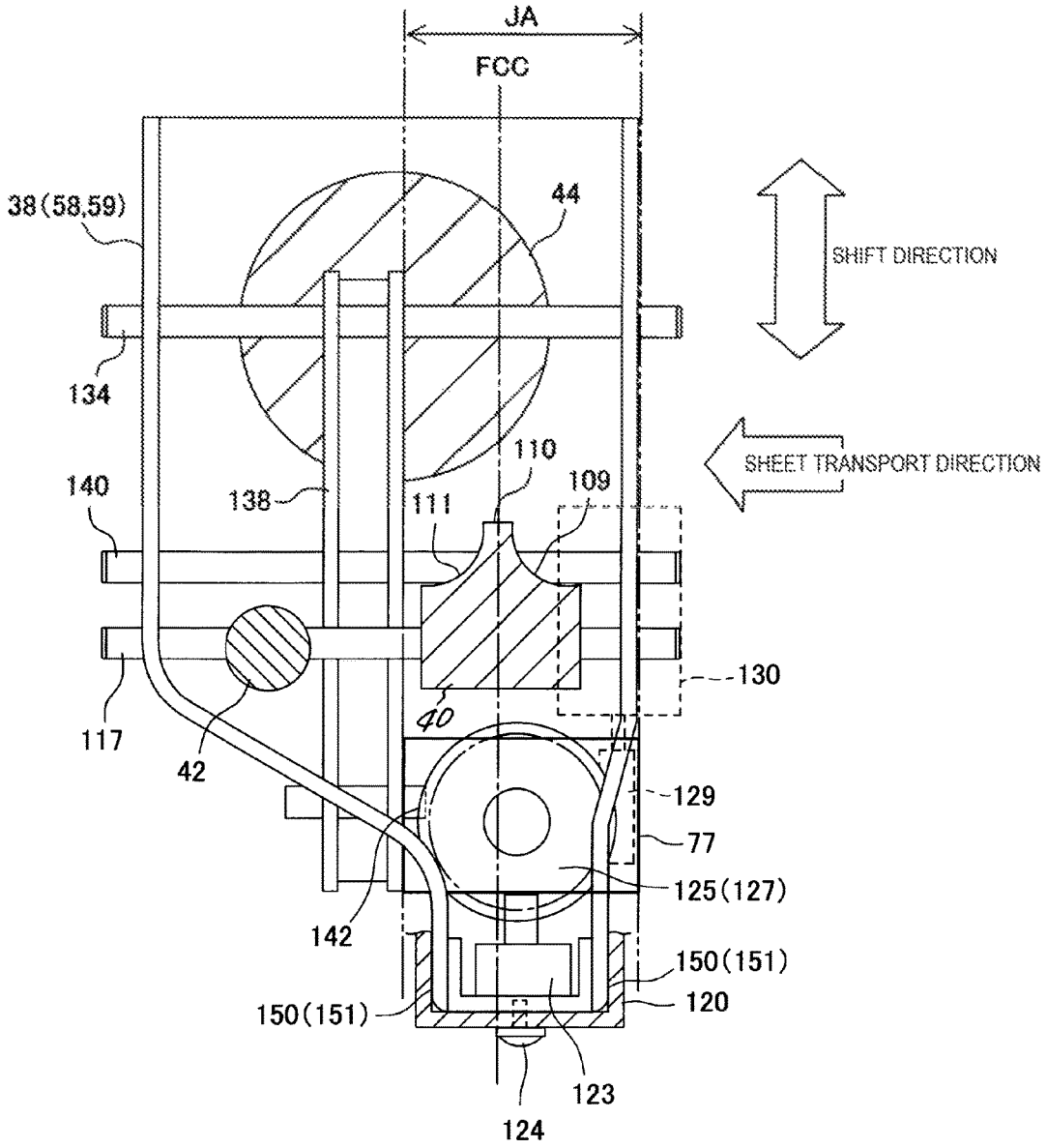
FIG. 9 is an arrangement explanatory view of a cut blade•punch blade•emboss section with a support frame obtained by joining opposite cut blade frame and receiving blade frame.

FIG. 9 illustrates an arrangement relationship, as a plan view in a transparent manner, of the support frame 38 on the front side comprised of the cut blade frame 58 and receiving blade frame 59 described in the foregoing. The vertical arrow shown in FIG. 9 indicates a shift direction of the support frame 38, and the left arrow indicates the sheet transport direction. According to the shift direction of the support frame 38, the shift lever 120, shift cam 125, joint portion 77, next the cut blade 40 and punch blade 42 are positioned, while mutually overlapping in the sheet transport direction, and the emboss section 44 is positioned on the most inward side in the sheet width direction. In the cut blade 40, the lead edge cut blade 109 and end edge cut blade 111 are disposed back to back. More specifically, the lead edge cut blade 109 and end edge cut blade 111 are configured substantially line symmetrically with respect to a front-side cut center FCC passing through a cut blade center 110 as a center. By this means, corners of sheets are cut in a single portion.

Further, the cut blade 40 is positioned on the inner side in the sheet width direction of the range (Joint Area) JA in which the joint portion 77 for fixing and joining the cut blade frame 58 and receiving blade frame 59 is positioned, and the punch blade 42 is provided on the downstream side of the JA. Accordingly, as described later, in the case of punching a punch hole in a sheet with the punch blade 42, in shifting the support frame 38, unless the joint portion 77 comes into contact with the side edge of a sheet, the support frame 38 is capable of shifting inside the width direction of the sheet. In other words, when corner portions of a sheet exist between the joint portion 77 and the punch blade 42, it is possible to punch a punch hole in an arbitrary position in the sheet width direction. In addition, in the shift lever 120 with a part shown by oblique lines in the lower end shown in the figure, although some midpoint is omitted, in order that the lever is capable of sliding, while covering corner portions of the cut blade frame slide portion 150 and receiving blade frame slide portion 151, a guide screw 124 is attached to the lever 120.

[Explanations of the Cut Blade 40 and Punch Blade 42 from Each Direction]

Figure 10:
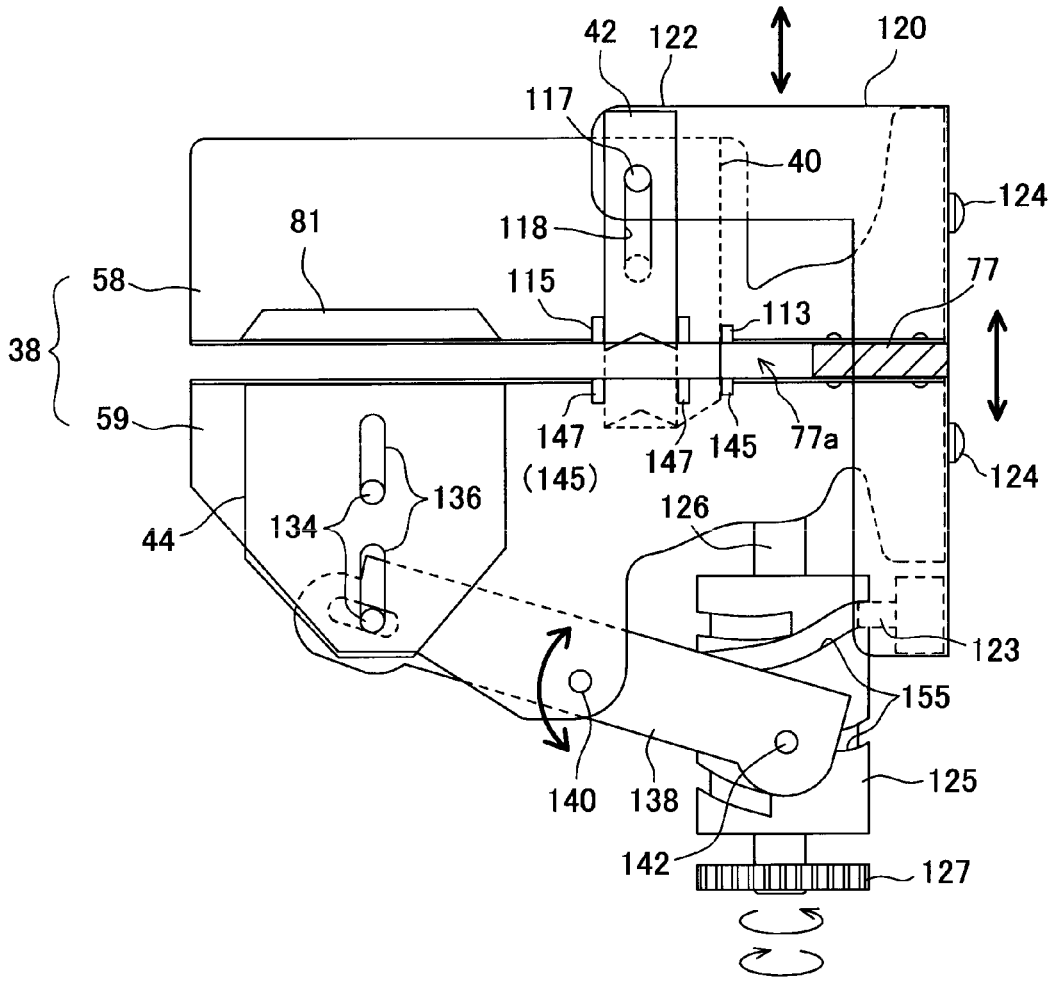
FIG. 10 is an explanatory view from the punch blade side of the support frame.

FIG. 10 is an explanatory view of the support frame 38 viewed from the punch blade 42 side. As can be seen from the figure, the punch blade 42 and cut blade 40 are disposed so as to overlap in the transport direction of a sheet. In the receiving blade frame 59, the cut receiving blade 145 and punch receiving blade 147 for receiving respective blades are disposed opposite one another. In the punch blade 42 and cut blade 40, the engagement portion of the shift lever 120 engages in a cam groove 155 of the shift cam 125, and the blades 42, 40 operate up and down by forward/backward of the shift cam 125. Further, also in the emboss section 44, the cam engagement portion 142 of the rotating arm 138 engages in the shift cam 125, and the emboss section 44 shifts up and down by rotation of the shift cam 125.

Figure 12:
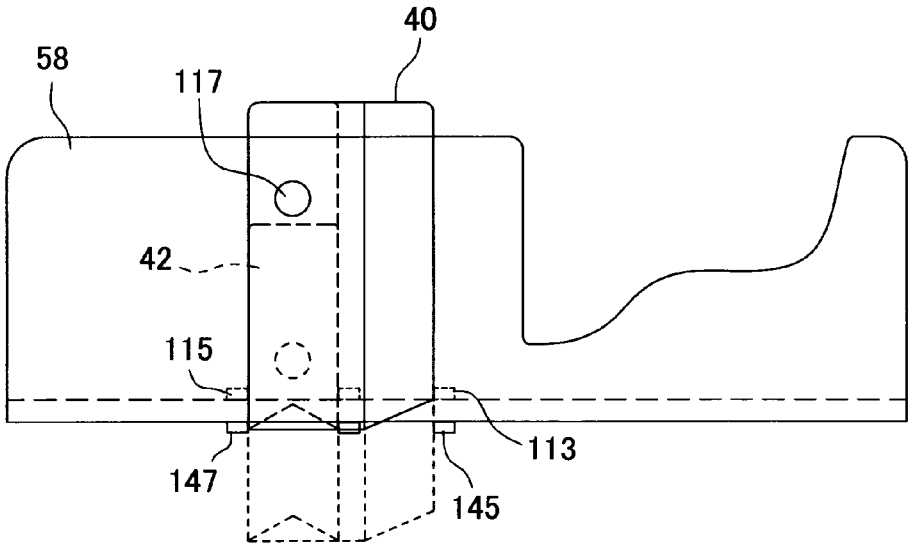
FIG. 12 is an explanatory view of a shift lever for shifting the cut blade and punch blade attached to the support frame.

FIG. 11 is a view of the cut blade 40 and punch blade 42 of FIG. 10 viewed from the shift lever 120. The shift lever 120 is capable of sliding in the cut blade frame 58 and receiving blade frame 59 by the guide bis 124 in a shift lever slide groove 121. Further, also in the figure, a cut area CA is provided so that the cut blade 40 overlaps the joint portion 77 joint area JA, and a punch area PA for enabling the punch blade 42 to punch is set in a position that does not overlap the joint area JA. Furthermore, as shown in FIG. 12, the cut blade 40 and punch blade 42 are disposed so as to overlap in the sheet transport direction.

[Configuration of the Cam Groove 155 of the Shift Cam 125]

Figure 13:
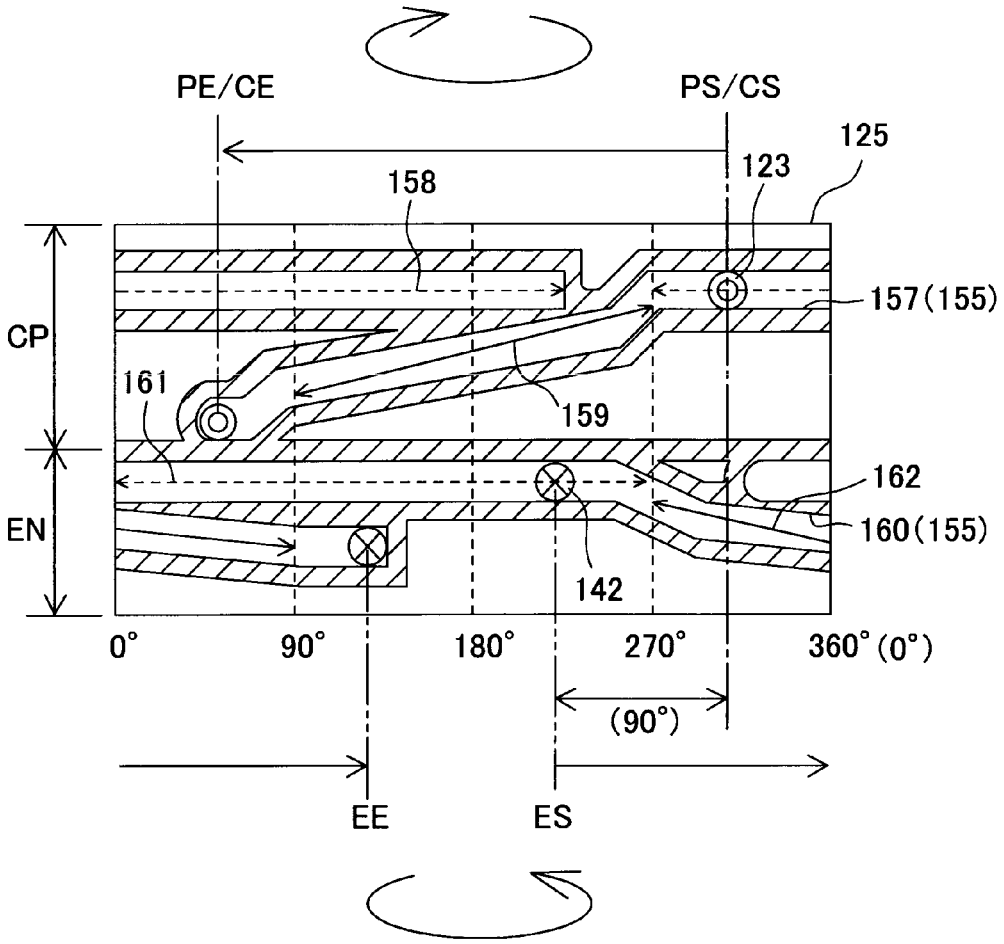
FIG. 13 is an explanatory view of a shift cam for shifting the cut blade•punch blade•emboss section.

Described next is the cylindrical shift cam 125 that shifts the shift lever 120 for shifting the cut blade 40 and punch blade 42 up and down and the rotating arm 138 for shifting the emboss section 44 up and down described in the foregoing. FIG. 13 is a plan view developed to explain the cam groove 155 formed in the cylindrical shift cam 125. In this figure, the upper stage side divided by the arrow on the left side as viewed in the figure indicates a cut•punch groove range CP for shifting the cut blade 40 and punch blade 42 up and down, and the lower stage is an emboss groove range EN for shifting the emboss section 44 up and down.

More specifically, in the cut•punch groove range CP is provided a cut blade•punch blade shift groove 157 in which engages the engagement portion 123 (shown by the double circle in the figure) of the shift lever 120. On the other hand, in the low-stage emboss groove range EN is provided an emboss section shift groove 160 in which engages the cam engagement portion 142 (shown by the cross inside the circle in the figure) of the rotating arm 138. The engagement portion 123 of the shift lever 120 and the cam engagement portion 142 of the rotating arm 138 engage with phases of a cut•punch start position (PS/CS) and emboss section start position (ES) shifted by 90 degrees.

[Shift of the Cut Blade 40 and Punch Blade 42]

As described already, the shift motor 130 for driving and rotating the shift cam 125 switches the drive direction in the case of shifting the cut blade 40 and punch blade 42 up and down, and in the case of shifting the emboss section 44 up and down. First, in the case of shifting the cut blade 40 and punch blade 42, the shift motor 130 is driven to rotate the shift cam 125 in a clockwise direction. By this rotation, the shift cam 125 shifts in the arrow direction from the PC/CS position to a PE/CE position shown in the figure.

By this shift, the engagement portion 123 (shown by the double circle in the figure) of the shift lever 120 moves down in a cut blade•punch blade shift region 159. By this means, the cut blade 40 and punch blade 42 cut corners of a sheet and punch a punch hole. On the other hand, when the engagement portion 123 of the shift lever 120 is in the cut blade•punch blade shift region 159, the emboss section shift groove 160 in which engages the cam engagement portion 142 (shown by the cross inside the circle in the figure) of the rotating arm 138 is an emboss section dead region 161 in a substantially linear state, and the emboss section 44 is in a waiting state in a position for not contacting a sheet.

[Press Shift of the Emboss Section 44]

Described next is operation of the shift cam 125 that shifts the emboss section 44. In the case of shifting the emboss section 44, the shift motor 130 is driven to rotate the shift cam 125 in a counterclockwise direction. By this rotation, the shift cam 125 rotates in the arrow direction from the ES position to an EE position shown in FIG. 13. By this shift, the cam engagement portion 142 (shown by the double circle in the figure) of the rotating arm 138 moves down in the emboss groove range EN, and by this means, the emboss section 44 is pressed against a sheet, and stamps a mark on the sheet.

On the other hand, in the case where the cam engagement portion 142 of the rotating arm 138 is in an emboss section shift range 162, the cut blade•punch blade shift groove 157 in which engages the engagement portion 123 (shown by the double circle in the figure) of the shift lever 120 is a cut blade•punch blade dead region 158 in a substantially linear state to prevent the cut blade 40 and punch blade 42 from shifting up and down.

In this way, in the Embodiment of the invention, a single motor 130 rotates a single shift cam 125 forward and backward, it is thereby possible to selectively shift the cut blade 40•punch blade 42 and the emboss section 44, and therefore, the drive configuration is streamlined.

[Addition Procedure of Corner Cut•Punch•Emboss]

The procedure will be described according to transport of a sheet with reference to FIGS. 14 to 17. The procedure is that the corner cut•punch unit 30 configured as described above cuts corners at the lead edge and end edge of a sheet in a convex R shape, further punches punch holes on the end-edge side, and furthermore, adds an embossed mark to the sheet.

[Sheet Carry-In and Lead Edge Corner Cut]

Figure 14:
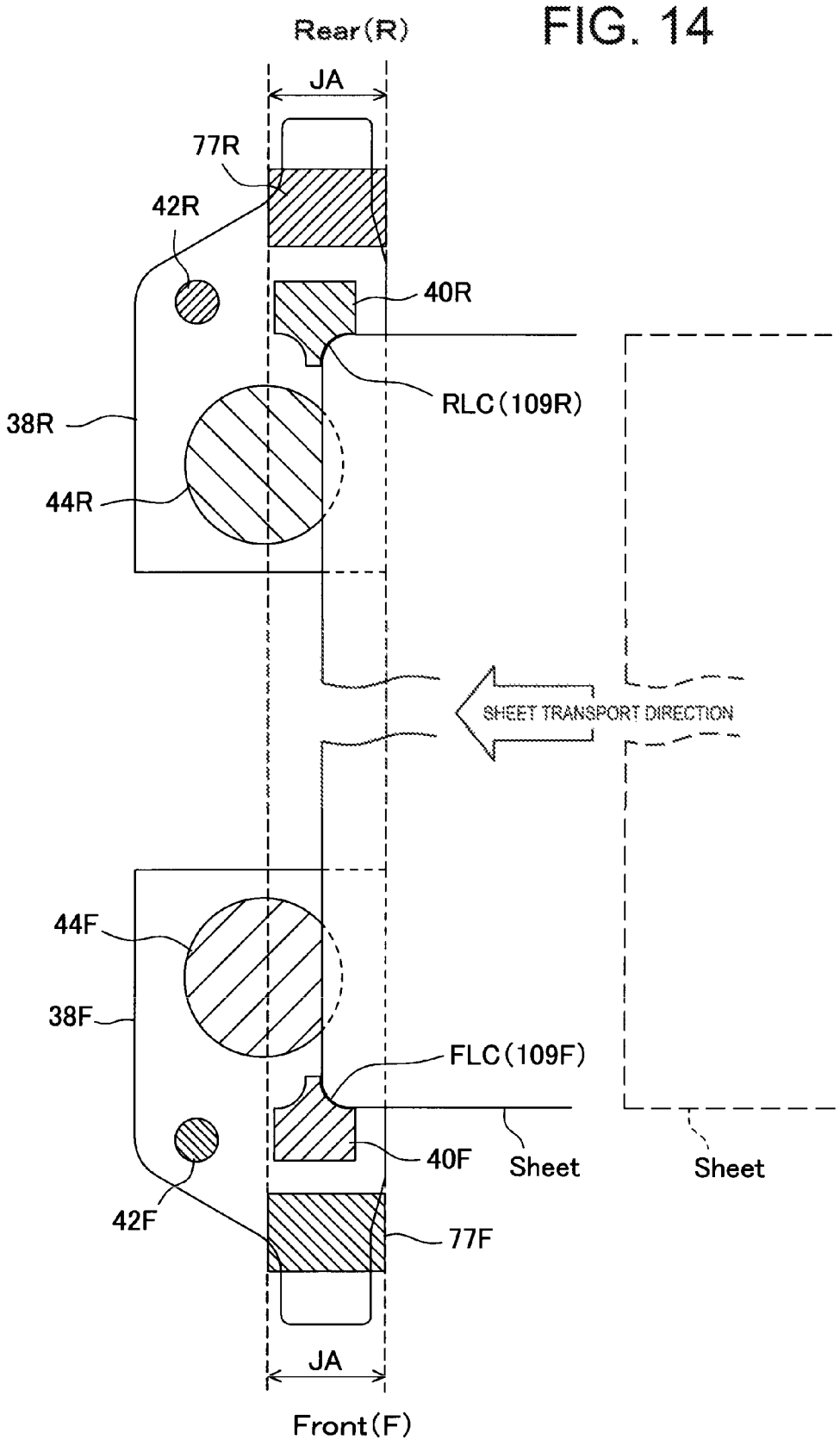
FIG. 14 is an explanatory view illustrating a position relationship between the sheet and the support frame, and illustrating a state in which a sheet is carried in and corners of the sheet lead edge are cut.

FIG. 14 is an explanatory view illustrating a state in which a sheet is carried in and corners of the sheet lead edge are cut by the cut blade. In FIG. 14, in FIG. 6 described already, a sheet is carried in (sheet shown by dashed lines in the figure carried in from the right side), the front-side lead edge cut blade 109F makes the front-side lead edge cut FLC in the sheet, and the rear-side lead edge cut blade 109R makes the rear-side lead edge cut RLC in the sheet. Before the sheet is carried in, the front-side support frame 38F and rear-side support frame 38R shift to positions close to the sheet, corresponding to the size of the sheet. In the positions, the frames wait for carry-in of the sheet with the front-side sheet lead/end edge sensor 106F and rear-side sheet lead/end edge sensor 106R, and detect that the sheet does not have predetermined or more skew with each of the above-mentioned sensors to halt the sheet.

After halting the sheet, the front-side support frame 38F and rear-side support frame 38R shift further inside in the sheet width direction, the front-side sheet side edge sensor 107F and rear-side sheet side edge sensor 107R detect the sheet side edges, and at the time of finishing detection (rising of a sensor signal), the front-side support frame 38F and rear-side support frame 38R are halted. The position just corresponds to the convex curved shape in corners on the front side and rear side of the sheet lead edge, and the front-side cut blade 40F and rear-side cut blade 40R are shifted by the shift cam 125 and make the front-side lead edge cut FLC and rear-side lead edge cut RLC in the sheet as shown in the figure. After cutting the lead edge, the sheet is transported again.

[Addition of Embossed Marks]

Figure 15A:
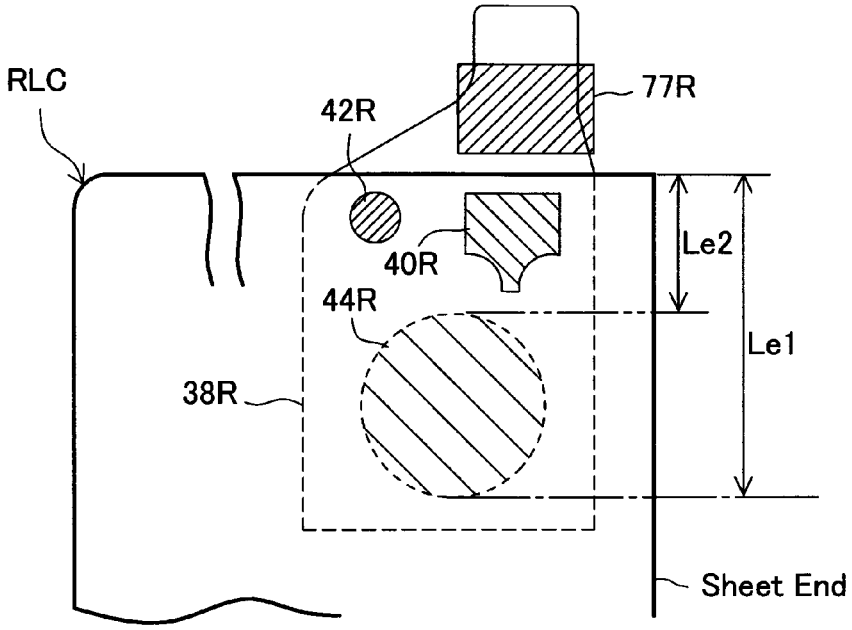
FIGS. 15A and 15B contain explanatory views of states for performing embossing on opposite sides in a width direction of the sheet continued from FIG. 14, where
Figure 15B:
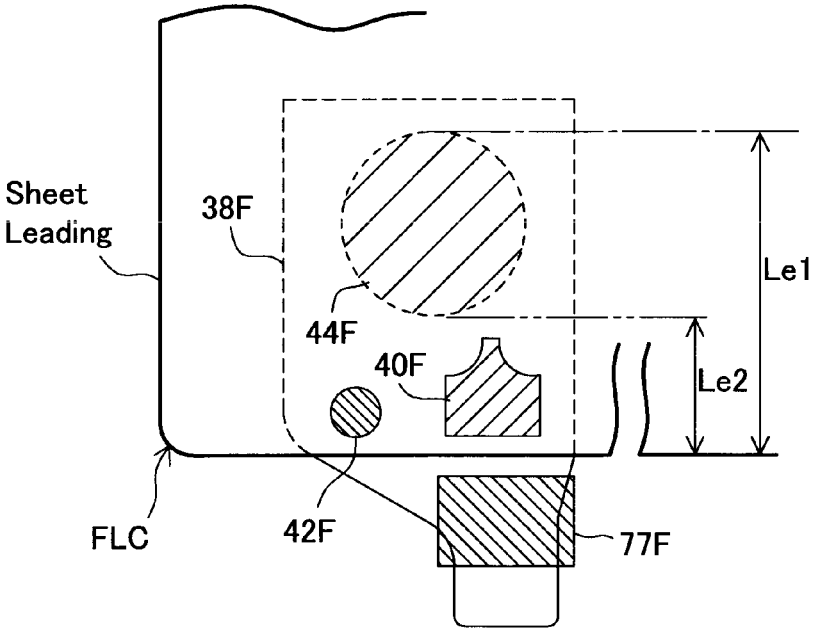

Referring to FIGS. 15A and 15B, described next is a state for performing embossing on both sides in the width direction of the sheet continued from FIG. 14. FIGS. 15A and 15B illustrate two embossing states, where FIG. 15A is an explanatory view illustrating performing embossing on the apparatus rear side, and FIG. 15B is an explanatory view illustrating a state of performing embossing on the apparatus front side.

In FIG. 15A, for the lead edge of the sheet subjected to the rear-side lead edge cut RLC by the rear-side support frame 38R, for example, by counting a counter interlocked with sheet transport subsequent to detection by the rear-side sheet lead/end edge sensor 106R, the sheet is halted in an arbitrary predetermined position (lead•middle•end). After halting, the shift cam 125 is rotated to press the emboss section 44 against the sheet. In the case shown in FIG. 15A, the emboss section 44 makes the mark near the sheet end edge on the rear side.

In addition, a range for enabling an embossed mark to be made by the corner cut•punch unit 30 is up to a position on the inner side from the sheet side edge corresponding to Le1. In the case of the more inward portion (inside shift of Le2 or more shown in the figure), the sheet collides with the rear-side joint portion (spacer) 77R, and therefore, this range is set. This respect is the same as in the front-side support frame 38F described next. Then, after making the mark by the emboss section 44, the sheet is transported again, and is transported to the downstream side.

Next, in FIG. 15B, for the lead edge of the sheet subjected to the front-side lead edge cut FLC by the front-side support frame 38F, for example, by counting a counter interlocked with sheet transport subsequent to detection by the front-side sheet lead/end edge sensor 106F, the sheet is halted in an arbitrary predetermined position (lead•middle•end). After halting, the shift cam 125 is rotated to press the emboss section 44 against the sheet. In the case shown in FIG. 15B, the emboss section 44 makes the mark near the sheet lead edge on the front side, and after completing making of the mark, the sheet is transported again to the downstream side. In addition, this Embodiment illustrates that the mark is added by forming a concavo-convex pattern on the sheet surface by stamping using the emboss section 44. As well as the embossed mark, for example, a red seal mark may be added by ink with a stamp, and it is naturally essential only that the apparatus is capable of adding a mark to a sheet.

[Corner Cut of the Sheet End Edge]

Figure 16:
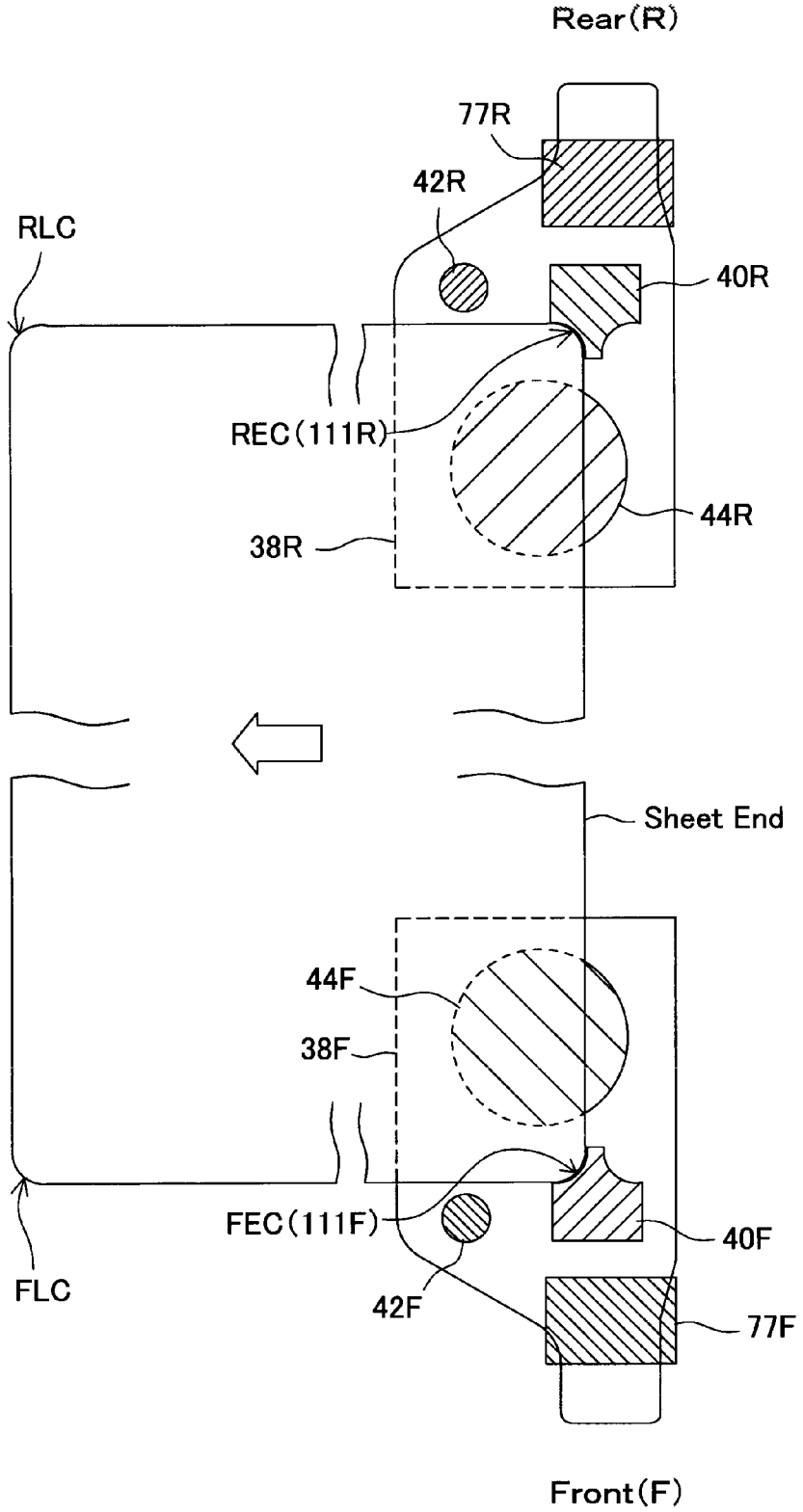
FIG. 16 is an explanatory view illustrating a state for cutting corners of the sheet end edge continued from FIGS. 15A and 15B.

Referring to FIG. 16, described next is a state for cutting corners on the sheet end edge after transporting, continued from FIGS. 15A and 15B. For a position corresponding to the end edge of the sheet provided with the embossed mark, a counter interlocked with sheet transport is counted subsequent to detection (of the sheet end edge) by the front-side sheet lead/end edge sensor 106F of the front-side support frame 38F and the rear-side sheet lead/end edge sensor 106R of the rear-side support frame 38R, and the sheet is halted in a position in which the sheet end edge corresponds to the front-side end edge cut blade 111F and rear-side end edge cut blade 111R of the cut blade 40. By this means, the front-side end edge cut FEC and rear-side end edge cut REC are executed on the sheet. In addition, as shown in FIG. 16, since the front-side cut blade 40F and rear-side cut blade 40R are provided on the inner side respectively of the front-side joint portion 77F and rear-side joint portion 77R in the sheet width direction, the blades do not collide with the sheet edge portion, and are capable of cutting corners on the front side and rear side of the sheet in a curved manner. After executing the front-side end edge cut FEC and rear-side end edge cut REC, the sheet is transported again to the downstream side (left as viewed in the figure).

[Punching of Punch Holes on the Sheet End-Edge Side and Carrying-Out]

Figure 17:
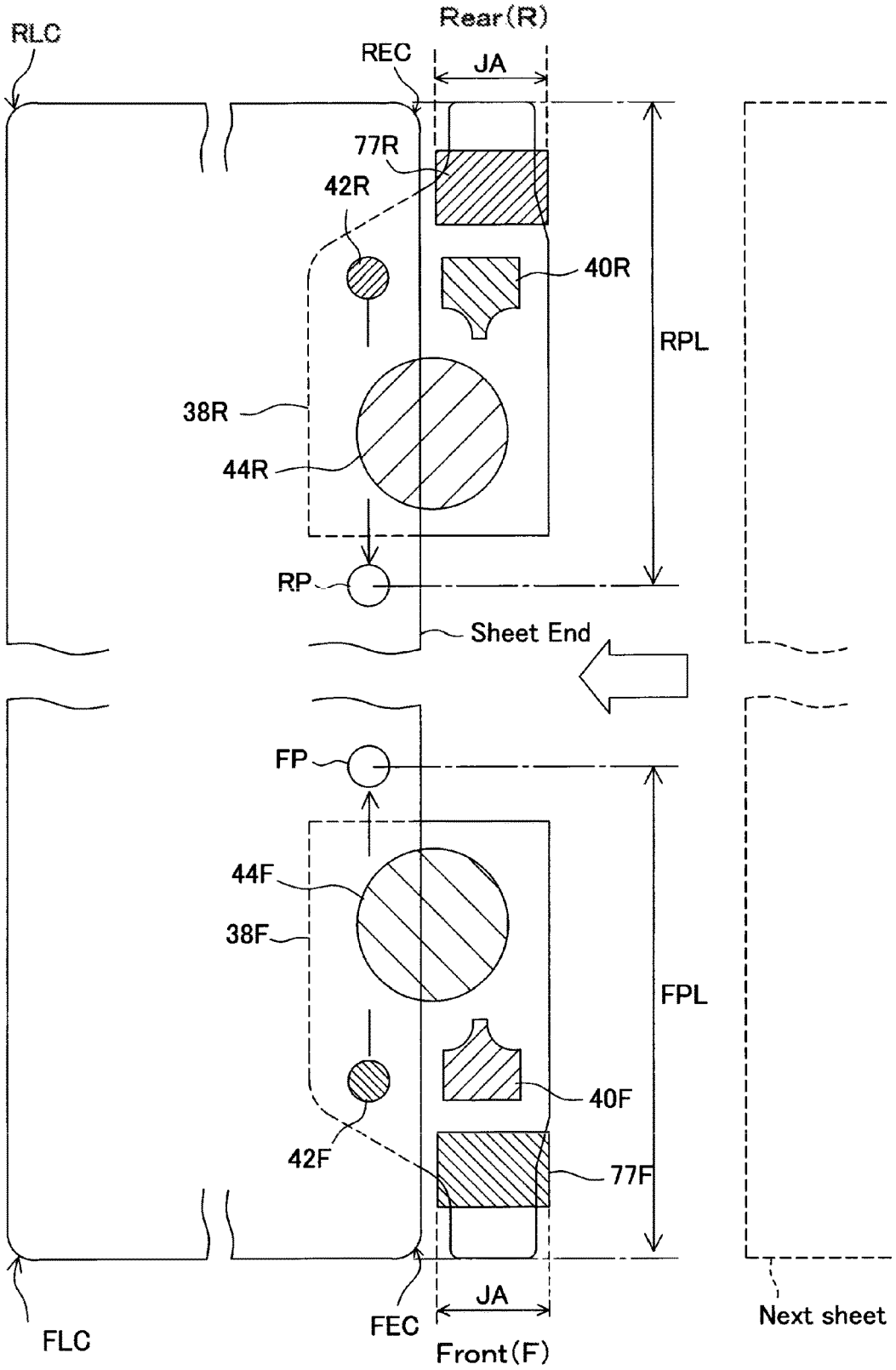
FIG. 17 is an explanatory view illustrating a state for punching punch holes near the end edge side of the sheet continued from FIG. 16.

FIG. 17 is an explanatory view illustrating a state for punching punch holes near the end-edge side of the sheet with the punch blades 42, continued from FIG. 16. The position shown in the figure is set by counting the counter interlocked with sheet transport subsequent to detection (of the sheet end edge) with the front-side sheet lead/end edge sensor 106F of the front-side support frame 38F and the rear-side sheet lead/end edge sensor 106R of the rear-side support frame 38R described in FIG. 6. Further, the set position is set so that the sheet end edge (Sheet End) is on the downstream displaced from the joint portion area JA. By thus setting, the front-side support frame 38F and rear-side support frame 38R are capable of shifting (shifting in the front-side punch range FPL, rear-side punch range RPL shown in the figure) inside the sheet width. Further, concurrently therewith, particularly, as in the Embodiment shown in FIGS. 9 and 10, it is possible to shift the cut blade 40 and punch blade 42 by the same drive source concurrently, and it is possible to attain commonality and streamlining of the drive source. After thus punching punch holes in the sheet, the sheet is transported again and discharged. In accordance with the carrying-out, the next sheet (Next sheet shown by dashed lines in the figure) is carried in.

As described above, it is possible to punch the front-side punch hole FP and rear-side punch hole RP by the front-side punch blade 42F and rear-side punch blade 42R in arbitrary positions within the shift ranges of the front-side support frame 38F and the rear-side support frame 38R. In addition, in the foregoing, shown as detection sensors of the sheet are the front-side sheet lead/end edge sensor 106F of the front-side support frame 38F and the rear-side sheet lead/end edge sensor 106R of the rear-side support frame 38R, and detection may be performed with another fixed sensor (for example, unit carry-in sensor Sen1 in FIG. 4) capable of detecting the lead edge and end edge of the sheet.

[Output Sheet of the Corner Cut•Punch Unit 30]

Figure 18A:
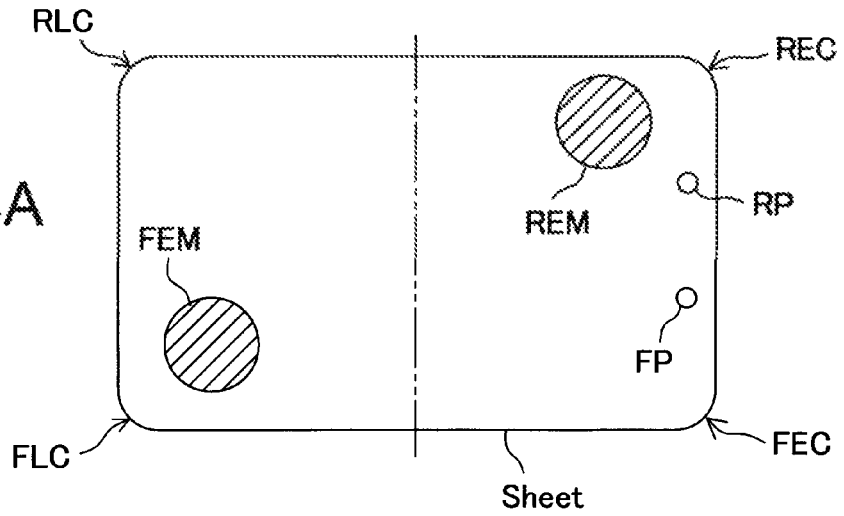
FIGS. 18A to 18C illustrate sheets subjected to each processing of corner cuts, embossed marks, and punching by the cut blade•punch blade•emboss section in FIGS. 14 to 16, where
Figure 18B:
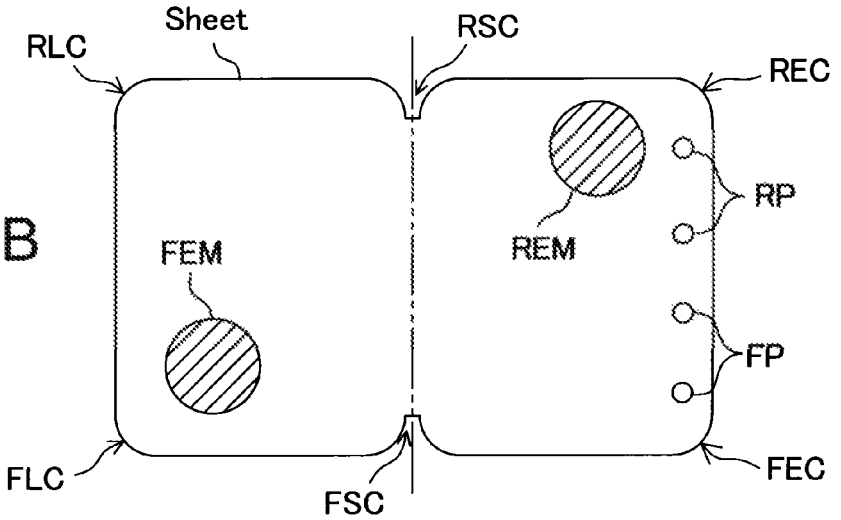
Figure 18C:
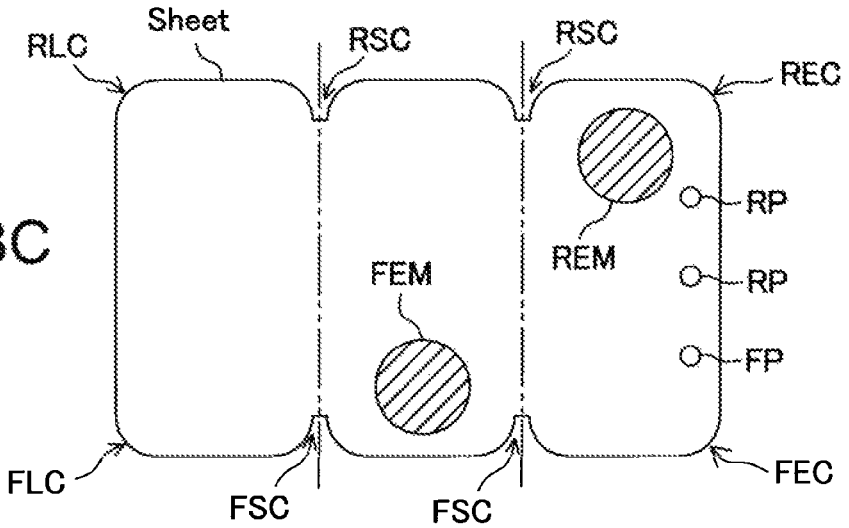

FIGS. 18A to 18C illustrate sheets subjected to processing by the corner cut•punch and emboss method in FIGS. 14 to 16 as described above. FIGS. 18A to 18C illustrate sheets subjected to each processing of the corner cut, embossed mark and punching by the cut blade, punch blade and emboss section.

First, FIG. 18A illustrates a sheet subjected to the corner cut on opposite corner portions of the lead and end edges of the sheet, embossing and punching. In other words, the sheet is provided with the front-side lead edge cut FLC, rear-side lead edge cut RLC, front-side embossed mark FEM, and rear-side embossed mark REM. Further, on the end-edge side, the front-side punch hole FP and rear-side punch hole RP are punched, and in addition thereto, on the sheet end-edge side, the front-side end edge cut FEC and rear-side end edge cut REC are made. By thus enabling the processing to be performed, corners of the sheet are hard to bend, it is possible to make the visually tender sheet, and further, it is possible to create distinctive sheets for enabling bills to be issued by filing binding and mark addition.

Next, FIG. 18B illustrates a sheet with curve-shaped cuts made by the cut blade in edge portions in the sheet center in the width direction in the sheet shown in FIG. 18A. In other words, the sheet is provided with cuts of a front side-edge cut FSC by the cut blade 40 in the side edge on the front side of the sheet in the sheet transport direction and rear side-edge cut RSC on the rear side. The cuts are made by shifting the lead edge cut blades 109 and the end edge cut blades 111 of the cut blade 40 to the sheet to make cuts in the side edges on the front side and rear side, and in the case of the folding the sheet, are also made indication of the folding position. Further, in the sheet in the figure, two portions of each of the front-side punch hole FP and rear-side punch hole RP are provided to enable four-hole filing and the like to be made.

Further, FIG. 18C illustrates a sheet with curve-shaped cuts made by the cut blade in edge portions in the width direction of folds in folding the sheet of FIG. 18A in three. In other words, two front side-edge cuts FSC by the cut blade 40 in the side edge on the front side and two rear side-edge cuts RSC on the rear are made in the sheet in the sheet transport direction. The side edge cut is the same as in FIG. 10B. Further, three punch holes (one front-side punch hole FP and two rear-side punch holes RP) are punched. In this way, the corner cut•punch unit 30 of this Embodiment is capable of performing various types of sheet processing by the compact mechanism.

Another Embodiment 1 and Another Embodiment 2 of the Cut Blade

Figure 19A:
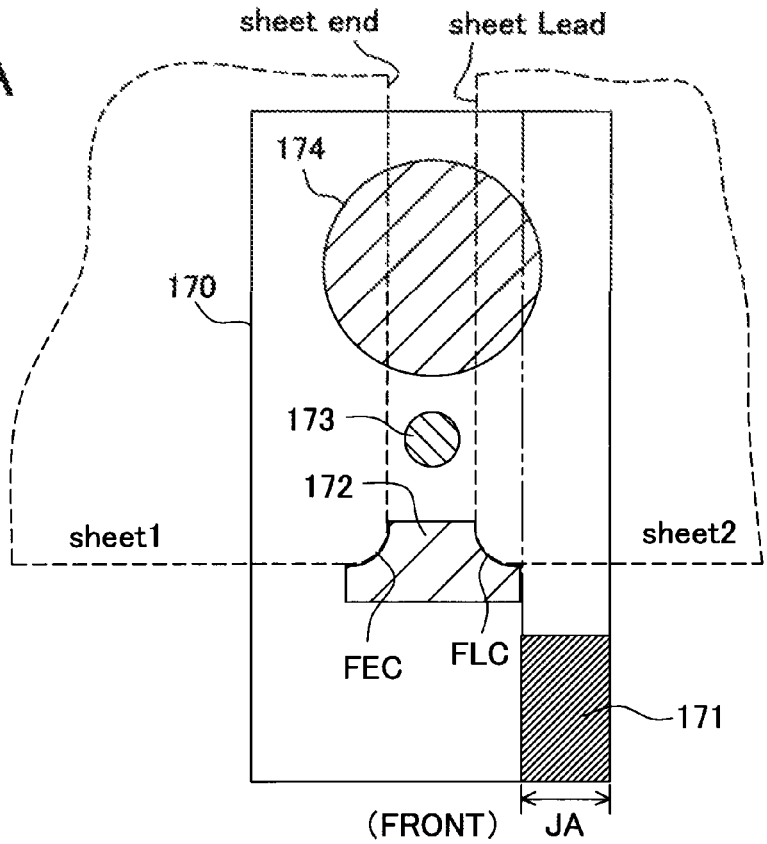
FIGS. 19A and 19B illustrate another Embodiment showing Modifications of the arrangement of the cut blade•punch blade•emboss section arranged in the support frame shown in FIGS. 4 to 17, where

FIGS. 19A to 20 described herein illustrate other Embodiments showing Modifications of the arrangement of the cut blade•punch blade•emboss section disposed in the support frame shown in FIGS. 4 to 17.

First, as another Embodiment 1, FIG. 19A illustrates a support frame 170 on the front side where substantial centers of a cut blade 172, punch blade 173 and emboss section 174 are in line in the sheet width direction, and the rear side has the same configuration. In the foregoing, the cut blade and punch blade have a common drive, and are configured to move up and down at the same timing, and in contrast thereto, in this Embodiment, although not shown particularly, the cut blade 172, punch blade 173 and emboss section 174 are driven independently of one another. Further, the joint area JA of a joint portion (spacer) 171 is set in a position for not interfering with a shift in the sheet width direction of the punch blade 173. Also by thus configuring, it is possible to perform corner cuts, punching of punch holes, and making of embossed marks.

Figure 19B:
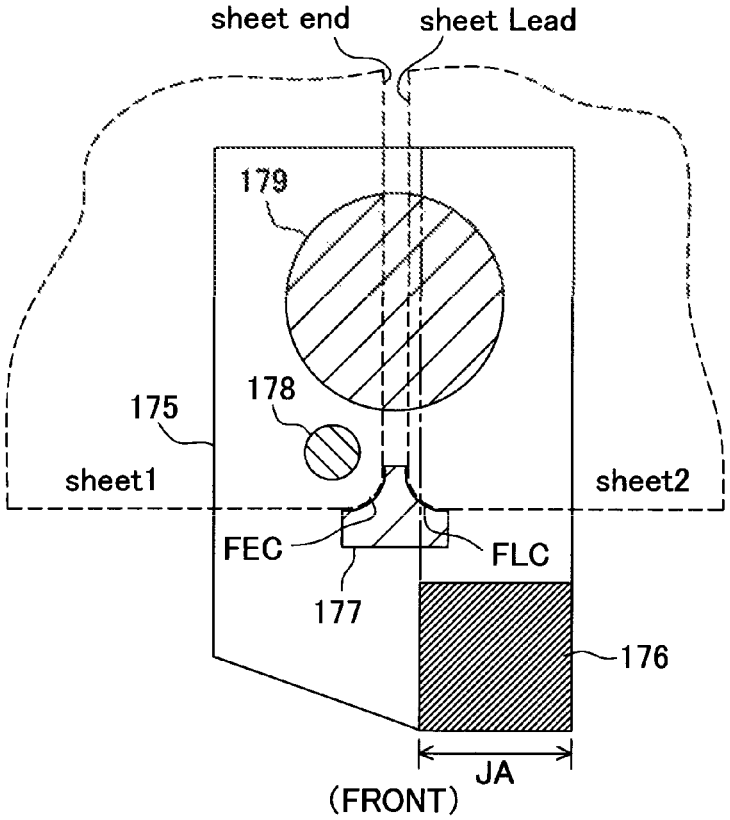

As another Embodiment 2, in FIG. 19B, a punch blade 178 is displaced to the downstream side in the sheet transport direction from a cut blade 177. Also in this Embodiment, the blades and emboss section 179 are driven independently of one another, and further, the joint area JA of a joint portion (spacer) 176 is set in a position for not interfering with a shift in the sheet width direction of the punch blade 178. Also by thus configuring, it is possible to perform corner cuts, punching of punch holes, and making of embossed marks.

Other Embodiments 3 and 4 of the Cut Blade

Figure 20A:
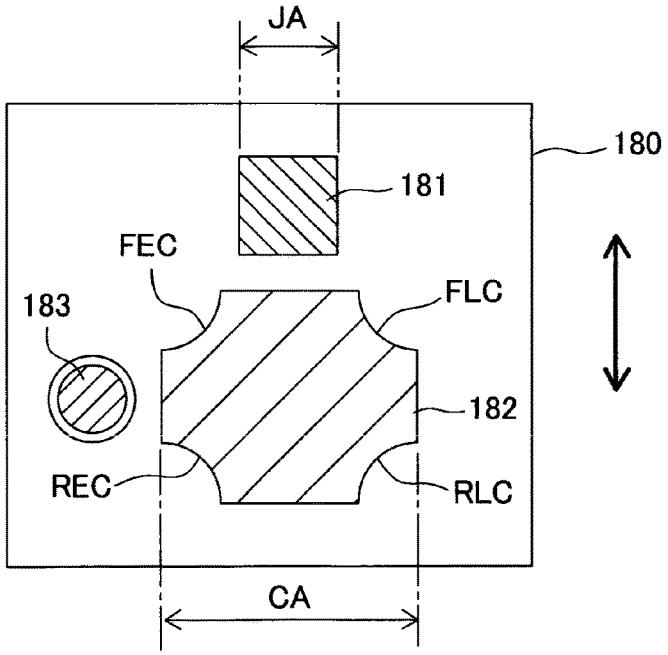
FIGS. 20A and 20B illustrate another Modification different from FIGS. 19A and 19B where the cut blade and punch blade are disposed in a single support frame, where
Figure 20B:
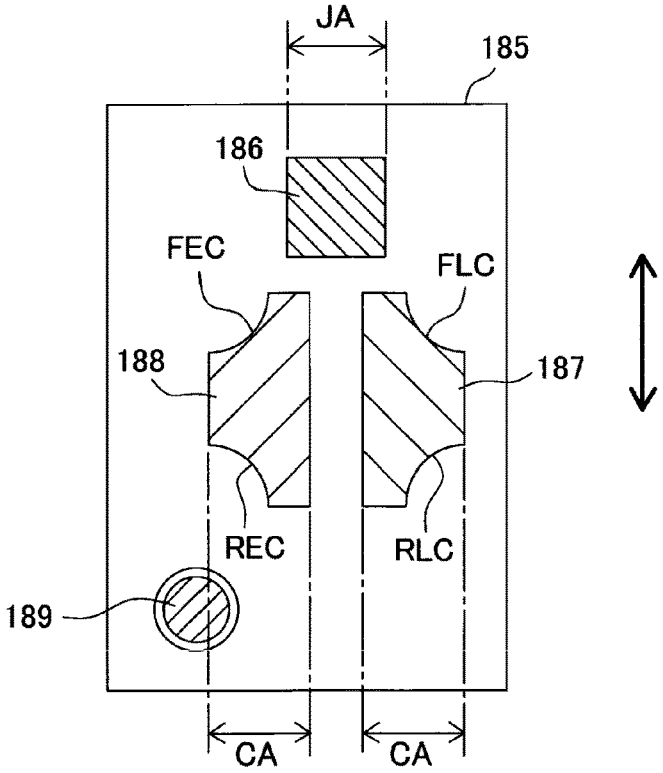

In the foregoing, as shown in FIG. 6, the support frame 38 is provided as a pair opposite each other in the sheet width direction (direction crossing the sheet transport direction), like the front-side support frame 38F and rear-side support frame 38R. FIGS. 20A and 20B illustrate Modifications different therefrom, where a cut blade 182 and punch blade 183 are disposed in a single support frame 180, and are configured to shift in the entire range (the arrow direction shown in the figure) in the sheet width direction. In the upper portion shown in the figure of the cut blade 182, a joint portion (spacer) 181 having the joint area JA is fixed and joined. According to this configuration, since a single support frame 180 shifts in the sheet width direction, although the processing speed is decreased, it is possible to simplify the mechanism of the corner cut•punch.

In other words, as another Embodiment 3, in FIG. 20A, on the downstream side of the four-direction cut blade 182, the punch blade 183 is displaced and disposed. In other words, the cut blade 182 has cut blades respectively in four corners thereof, and by this means, is capable of forming the front-side lead edge cut FLC, front-side end edge cut FEC, rear-side lead edge cut RLC and rear-side end edge cut REC in a sheet. Further, the punch blade 183 is provided, while being also displaced, and therefore, it is also possible to punch a punch hole in an arbitrary position of the sheet.

Next, in FIG. 20B, in a single support frame 185, the cut blade is divided into two in the center as a cut blade 187 and cut blade 188, and is disposed, while overlapping a punch blade 189 on the downstream side. The blades are also independent of one another in drive. On the other hand, as in the foregoing, the front-side lead edge cut FLC, front-side end edge cut FEC, rear-side lead edge cut RLC and rear-side end edge cut REC obtained by cutting corners of a sheet are in the back-to-back relationship, and more specifically, the blades are set in the substantially line symmetrical relationship with respect to the center line in the shift direction of the support frame 185 as a reference line. Further, the punch blade 189 does not overlap the joint area JA of a joint portion (spacer) 186, and also in this respect, the arrangement is the same as in the foregoing. By this means, it is possible to punch a punch hole in an arbitrary position in the sheet width direction.

Another Embodiment of the Cut•Punch Method

Figure 21:
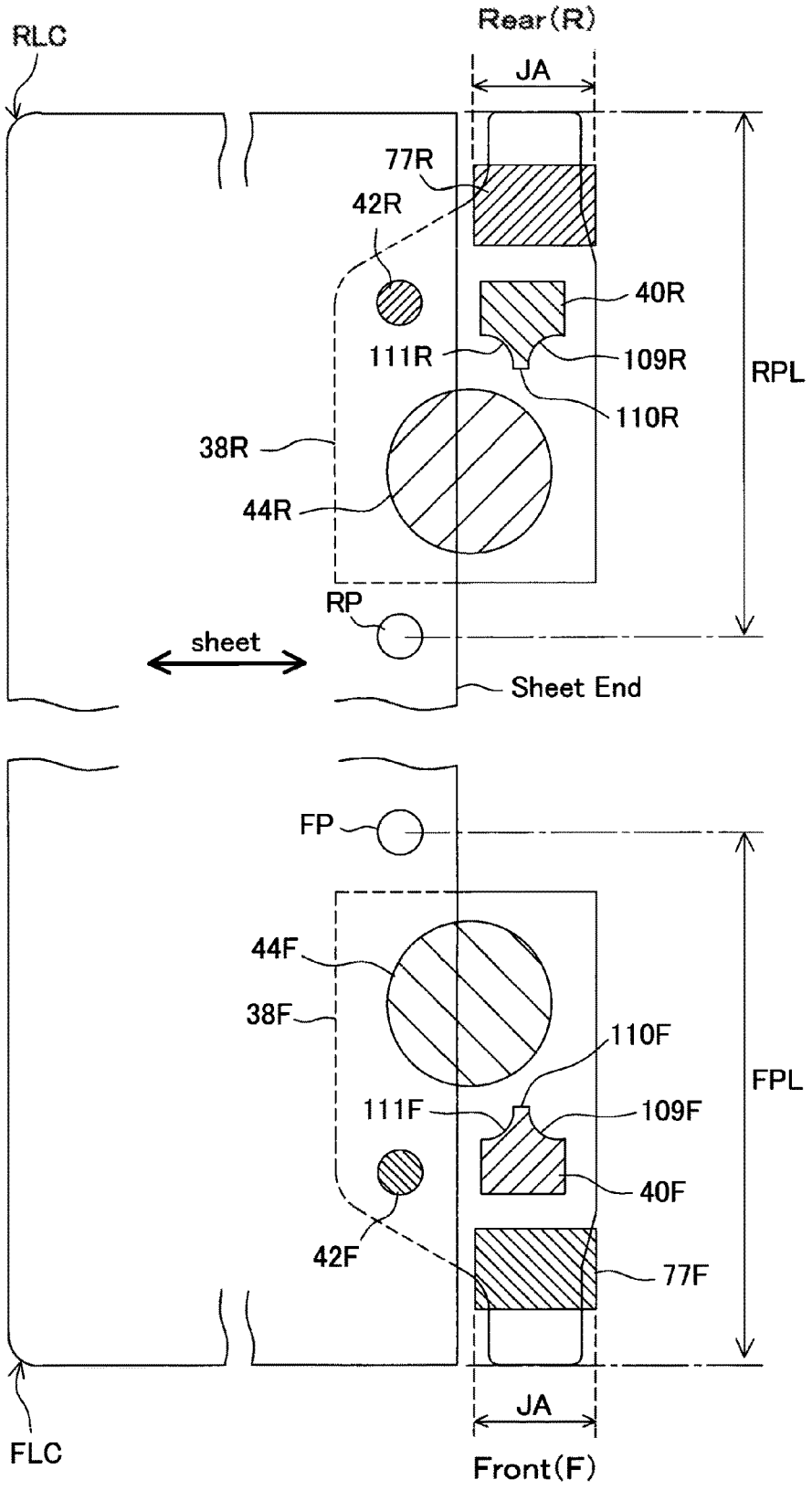
FIG. 21 illustrates another Embodiment where a part of the cut•punch method is changed, and is an explanatory view where punch holes are punched near the end edge side of the sheet continued from FIGS. 15A and 15B, and then, the sheet is switched back to cut corners.

FIG. 21 illustrates another Embodiment with a part of the cut•punch method changed, and is an explanatory view illustrating a state in which punch holes are first punched near the end-edge side of the sheet, continued from FIGS. 15A and 15B, and subsequently, the sheet is switch backed to cut corners. The cut•punch method from FIGS. 14 to 17 is to always transport the sheet to the downstream side, and in the apparatus shown in FIG. 21, continued from making of embossed marks in FIGS. 15A and 15B, punching punch holes (punching the front-side punch hole HP, rear-side punch hole RP) are first executed by the punch blade 42F and punch blade 42R. In addition, at this point, when the end edge of the sheet is brought into contact with the left side faces as viewed in the figure of the front-side joint portion 77F and rear-side joint portion 77R to correct the skew, and punch holes are then punched, accuracy of the punch position is more improved.

Subsequently, the support frame 38 is once retracted in the sheet width direction. Then, the sheet subjected to one-edge punch processing is switched back to position both corners on the end-edge side of the sheet in the front-side end edge cut blade 111F and rear-side end edge cut blade 111R. After checking the positioning, the front-side cut blade 40F and rear-side cut blade 40R are shifted to the sheet surface and cut the corners. At this point, when switchback of the sheet is checked with a sensor, position accuracy of the corner cut is more improved.

[Explanation of a Control Configuration]

Figure 22:
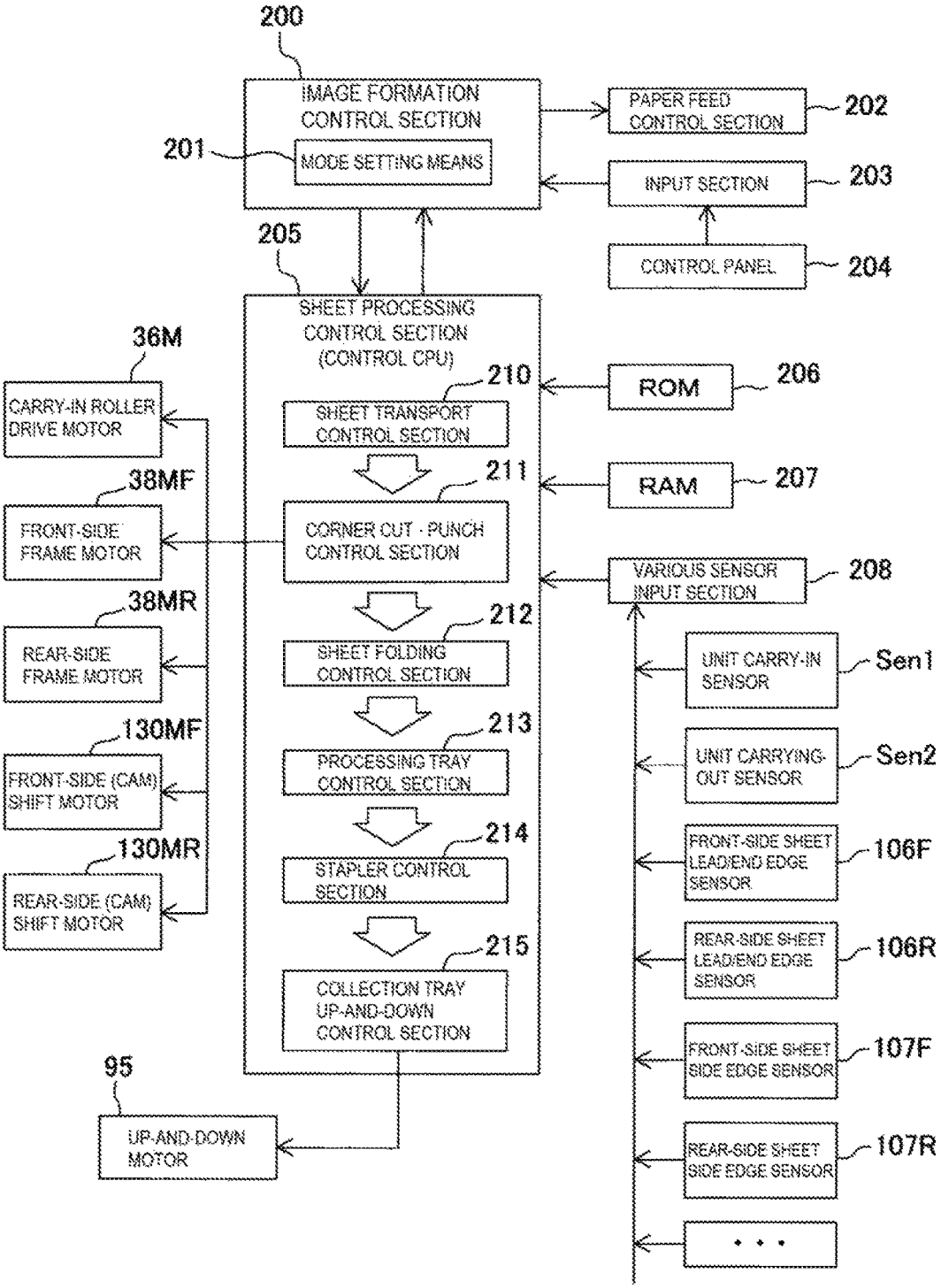
FIG. 22 is an explanatory view of a control configuration in the entire configuration of FIGS. 1 and 2.

A system control configuration of the image formation apparatus A provided with the sheet processing apparatus B including the corner cut•punch unit 30 as the corner cut•punch apparatus described above will be described according to a block diagram of FIG. 22. An image formation apparatus system shown in FIGS. 1 and 2 is provided with an image formation control section 200 of the image formation apparatus A and a sheet processing control section 205 (control CPU) of the sheet processing apparatus B including the corner cut•punch unit 30, folding unit 31, binding unit 32 and tray unit 33. The image formation control section 200 is provided with a paper feed control section 202 and input section 203. Then, from a control panel 204 provided in the input section 203 is performed setting of a sheet processing mode including "print mode", "corner cut mode", "sheet side-edge cut mode", "punch mode", "emboss mode", "sheet folding mode", "sheet binding mode" or the like and combination thereof described later.

The sheet processing control section 205 is a control CPU that operates the sheet processing apparatus B corresponding to the designated sheet processing mode as described previously. The sheet processing control section 205 is provided with ROM 206 storing operation programs, and RAM 207 storing control data. Further, for example, with respect to the corner cut•punch unit 30 according to the present invention, as shown in FIG. 4, to the sheet processing control section 205 are connected the unit carry-in sensor Sen1 that detects a sheet transported near a cut section carry-in roller 36, and a unit carrying-out sensor Sen2 that detects discharge of a sheet near the exit of the corner cut•punch unit 30. Further, to the section 205 are connected the front-side sheet lead/end edge sensor 106F provided in the front-side support frame 38F to detect the lead/edge end of a sheet, and the front-side sheet side edge sensor 107F that detects the side edge of the sheet on the front side. Similarly, to the section 205 are connected also the rear-side sheet lead/end edge sensor 106R of the rear-side support frame 38R, and the rear-side sheet side edge sensor 107R. Furthermore, although not shown in the figure, to the section are connected a paper level sensor that detects a paper surface level to detect a sheet load amount on the collection tray 90 and the like, and signals from a various sensor input section 208 are input to the section 205.

Next, the sheet processing control section 205 is provided with a sheet transport control section 210 that controls sheet transport of each unit of the corner cut•punch unit 30, folding unit 31, binding unit 32 and tray unit 33. Further, the sheet processing control section 205 is provided with a corner cut•punch control section 211 that controls so that corner cut•punch unit 30 performs cuts of both corners in the sheet lead and end edges, cuts in the sheet side edge, punching of punch holes, and making of embossed marks, a sheet folding control section 212 that controls so as to perform folding processing on a sheet, a processing tray control section 213 that controls the alignment plates 84 and the like in placing on the processing tray 76 to perform binding in the binding unit 32, a stapler control section 214 that controls the stapler 80 that performs binding processing on a bunch of sheets placed on the processing tray 76, and a collection tray up-and-down control section 215 that controls the collection tray 90 corresponding to a collection amount of sheets subjected to various sheet processing or sheets without being processed in the last stage.

Particularly, the corner cut•punch control section 211 (control section) that controls the corner cut•punch unit 30 according to the present invention controls drive of the carry-in roller drive motor 36M also connected to the sheet transport control section 210 for a sheet to carry in the corner cut•punch unit. Further, the corner cut•punch control section 211 controls the front-side frame motor 38MF that drives the front-side support frame 38F so as to shift forward and backward in the width direction crossing the sheet transport direction, and the rear-side frame motor 38MR that similarly shifts the rear-side support frame 38R forward and backward. By this means, the support frame 38 is shifted to a position close to the sheet width corresponding to the sheet size, and waits for carry-in of the sheet, and the sheet is halted. After halting, the section shifts the support frame 38 again to the inner side (close to the center) in the sheet width direction, and with side edge detection of the sheet, controls to halt entering operation of the support frame 38.

Further, the corner cut•punch control section 211 controls forward/backward rotation and halt of a front-side (cam) shift motor 130MF that drives the shift cam 125 on the front side to shift the front-side cut blade 40F, front-side punch blade 42F, and front-side emboss section disposed in the front-side support frame 38F up and down with respect to the sheet surface, and a rear-side (cam) shift motor 130MR that similarly drives the rear side. In rotation control of the front-side (cam) shift motor 130MF and rear-side (cam) shift motor 130MR, the shift cam 125 is driven according to the description shown in FIG. 13 to perform cuts of corners of a sheet, punching of punch holes, and making of embossed marks. These types of operation are performed according to processing of sheet processing step views from FIG. 14 to FIG. 17 and another processing step shown in FIG. 21 where a sheet is switched back.

Furthermore, although particularly not shown in the figure, for ascent/descent of the collection tray 90, the sheet processing control section 205 is provided with the collection tray up-and-down control section 215 that controls the up-and-down motor 95 based on detection signals from the paper surface level sensor.

[Sheet Processing Mode]

The sheet processing control section 205 of this Embodiment configured as described above causes the sheet processing apparatus B to execute, for example, (1) "print mode", (2) "corner cut mode", (3) "sheet side-edge cut mode", (4) "punch mode" (5) "emboss mode", (6) "sheet folding mode", (7) "sheet binding mode" and the like. The processing mode will be described below.

(1) "Print-Out Mode"

An image-formed sheet is received from the main-body discharge roller 16 of the image formation apparatus A, and the sheet is stored on the collection tray 90 on a sheet-by-sheet basis with the bunch discharge roller 86 via the cut section carry-in roller 36, binding carry-in roller 72 and carrying-out roller 74.

(2) "Corner Cut Mode"

Upon receiving sheet size information from the image formation apparatus A, the support frame 38 is shifted to the vicinity (for example, in FIG. 6, such a position that the front-side sheet lead/end edge sensor 106F detects the sheet lead edge to carry in, and that the front-side sheet side edge sensor 107F does not detect the sheet) of the sheet side edge, and an image-formed sheet is received from the main-body discharge roller 16. After detecting the lead edge of the sheet, the support frame 38 is shifted to a position (for example, a position for halting the support frame 38 at the time the front-side sheet side edge sensor 107F in FIG. 6 is switched from ON to OFF), and the cut blade 40 is shifted downward to cut the lead edge side of the sheet, and forms, on the sheet, the front-side lead edge cut FLC and rear-side lead edge cut RLC shown in FIGS. 6 and 14. Further, similarly, the front-side end edge cut FEC and rear-side end edge cut REC shown in FIGS. 6 and 16 are formed also on the sheet end edge side. In this way, in the corner cut mode, one corner or up to four corners of the sheet are cut in a curved or inclined manner. FIGS. 18A to 18C illustrate the sheet with four corners cut by the corner cut mode.

(3) "Sheet Side-Edge Cut Mode"

Upon receiving the sheet size information from the image formation apparatus A, the support frame 38 is shifted to the vicinity (for example, in FIG. 6, such a position that the front-side sheet lead/end edge sensor 106F detects the sheet lead edge to carry in, and that the front-side sheet side edge sensor 107F does not detect the sheet) of the sheet side edge, and an image-formed sheet is received from the main-body discharge roller 16. After detecting the lead edge of the sheet, the sheet is transported to the downstream side corresponding to a folding position that is a predetermined range, and the support frame 38 is halted. Subsequently, when the cut blade 40 is shifted downward, on the sheet are formed the front side-edge cut FSC and rear side-edge cut RSC. By execution of the sheet side-edge cut mode, it is possible to process the sheet that the side-edge cuts are made at midpoint in the transport direction of FIG. 18B, and the sheet that side-edge cuts are made in positions which correspond to three-fold positions of FIG. 18C.

(4) "Punch Mode"

An image-formed sheet is received from the main-body discharge roller 16 of the image formation apparatus A, and at the time the end edge of the sheet passes through the joint area JA that is a range of the joint portion 77 of the support frame 38, the front-side support frame 38F and rear-side support frame 38R are shifted to the inside (center direction) in the sheet width direction, and are halted in arbitrary positions for punching punch holes. Subsequently, the front-side punch blade 42F and rear-side punch blade 42R are moved down to the sheet surface, and punch the front-side punch hole FP and rear-side punch hole RP near the sheet end edge. By execution of the punch mode, it is possible to form punch holes in arbitrary positions such as two holes in FIG. 18A, four holes in FIG. 18B and three holes in FIG. 18C.

(5) "Emboss Mode"

Upon receiving the sheet size information from the image formation apparatus A, the support frame 38 is shifted to the vicinity (for example, in FIG. 6, such a position that the front-side sheet lead/end edge sensor 106F detects the sheet lead edge to carry in, and that the front-side sheet side edge sensor 107F does not detect the sheet) of the sheet side edge, and an image-formed sheet is received from the main-body discharge roller 16. After detecting the lead edge of the sheet, the frame is halted in a position for making a mark with an embossed mark. Further, also in the sheet width direction, the support frame 38 is positioned in an emboss allowed region Le1 shown in FIGS. 15A and 15B. Subsequently, the emboss section 44 is pressed against the sheet surface, and adds embossed marks with the emboss receiver 81. By execution of the emboss mode, as shown in FIGS. 18A to 18C, generated is the sheet provided with the front-side embossed mark FEM, and rear-side embossed mark REM. In addition, as described already, as well as the embossed mark, for example, a red seal mark may be added with a stamp, and it is essential only that the apparatus is capable of adding a mark to a sheet.

(6) "Sheet Folding Mode"

As shown from FIG. 1 to FIG. 4, a sheet from the transport path 37 of the corner cut•punch unit 30 is transported to the substantially cylindrical shape folding section 50 of the folding unit 31 to perform simple sheet folding, and the folded sheet is discharged to the apparatus front side crossing the sheet transport direction of the transport path 37.

(7) "Sheet Binding Mode"

Image-formed sheets from the main-body discharge roller 16 are temporarily placed as a bunch on the processing tray 76 of the binding unit 32 via the corner cut•punch unit 30 and folding unit 31, and this bunch is bound by the stapler 80, and is then collected on the collection tray 90.

According to the principal Embodiments disclosed to carry out the present invention as described above, the following effects are exhibited.

1. A corner cut apparatus (corner cut•punch unit 30) for entering into the transport path 37 of a transported sheet in a crossing direction to cut corners of the sheet is provided with the cut blade frame 58 that supports the cut blade 40 shifting with respect to a sheet surface, the receiving blade frame 59 that supports a receiving blade (cut receiving blade 145) for receiving the shifting cut blade, and a drive member (shift belt 71, frame drive motor 38M) that causes the cut blade frame 58 and the receiving blade frame 59 to enter into the transport path of the sheet, where blade shapes of the cut blade 40 and the receiving blade (cut receiving blade 145) are a back-to-back shape with an entry direction as a reference line (FCC line in FIG. 9).

According to the disclosure, since the cut blade for cutting corners of a sheet and the receiving blade that receives the blade are in a back-to-back shape with the same direction as the sheet width direction as a reference line, it is possible to provide the corner cut apparatus for cutting corners at the lead edge and end edge of the sheet in an inclined or curved manner, only by shifting (up and down) the blade with respect to the sheet surface.

2. A corner cut•punch apparatus for entering into the transport path 37 of a transported sheet in a crossing direction to cut corners of the sheet and punch a hole in the sheet is provided with the support frame 38 including the cut blade 40 for cutting corners of the sheet in an inclined or curved manner, and the cut receiving blade 145 for receiving the cut blade, and a drive section (shift belt 71, frame drive motor 38M) that causes the support frame 38 to enter and retract into/from the transport path, where the punch blade 42 for punching a hole in the sheet and the punch receiving blade 147 for receiving the punch blade are disposed in the support frame 38.

According to the disclosure, since the support frame for entering and retracting into/from the transport path of a sheet in the crossing direction supports the cut blade for cutting corners at the lead edge and end edge of the sheet in an inclined or curved manner and the punch blade, it is possible to provide the corner cut•punch apparatus which is capable of performing the corner cut and punching, and is relatively lightweight and compact.

3. A sheet corner cut•punch method, in a corner cut•punch apparatus comprised of the transport path 37 for transporting a sheet, the support frame 38 capable of entering and retracting into/from in a direction crossing the transport direction of a transported sheet, the cut blade 40 attached to the support frame to cut corners of the sheet in an inclined or curved manner, and the punch blade 42 that is provided in the support frame while being adjacent to the cut blade and that punches a punch hole in the sheet, includes a waiting step (position of the support frame 38 in FIG. 14) of shifting the support frame to the transport path to wait for arrival of a sheet, a lead edge cut step (FLC, RLC in FIG. 14) of halting the sheet after the sheet arrives, and cutting corners on the lead edge side of the sheet, an end edge cut step (FEC, REC in FIG. 16) of transporting the sheet to the downstream side after cutting corners on the lead edge side of the sheet, and halting the sheet to cut corners on the end edge side of the sheet, a punching step (FP, RP in FIG. 17) of transporting the sheet after cutting corners on the end edge side of the sheet, halting the sheet, shifting the support frame in the direction crossing the transport direction of the sheet, and punching punch holes in predetermined positions of the sheet, and a discharge step of discharging the sheet after punching the punch holes in the sheet.

According to the disclosure, the apparatus is relatively lightweight and compact, it is possible to cut corners at the lead edge and end edge of a sheet in an inclined or curved manner, and punch holes by the punch blade inside the same frame for entering/retracting, and further, it is possible to perform corner cut•punch, while feeding the sheet only in the forward direction.

4. A sheet corner cut•punch method, in a corner cut•punch apparatus comprised of the transport path 37 for transporting a sheet, the support frame 38 capable of entering and retracting in a direction crossing the transport direction of a transported sheet, the cut blade 40 attached to the support frame to cut corners of a sheet in an inclined or curved manner, and the punch blade 42 that is provided in the support frame while being adjacent to the cut blade and that punches a punch hole in the sheet, includes a sheet carry-in step of halting a sheet in a designated position of the transport path, a lead edge cut step (FLC, RLC in FIG. 14) of shifting the support frame (to a position of the support frame 38 in FIG. 4), and cutting corners on the lead edge side of the sheet with the cut blade, a punching step (FP, RP in FIG. 16) of transporting the sheet after cutting corners on the lead edge side of the sheet, halting the sheet, shifting in the direction crossing the transport direction of the sheet, and punching punch holes in predetermined positions of the sheet, an end edge cut step (FEC, REC in FIG. 17) of transporting the sheet again to the downstream side after punching the punch holes in the sheet, halting the sheet, and cutting corners on the end edge side of the sheet, and a discharge step of discharging the sheet with corners on the end edge side cut.

According to the disclosure, it is possible to provide the corner cut•punch method capable of causing the support frame to enter after carrying a sheet in, cutting corners at the lead edge and end edge of the sheet in an inclined or curved manner, and punching holes by the punch blade in the same support frame.

5. A sheet corner cut•punch method, in a corner cut•punch apparatus comprised of the transport path 37 for transporting a sheet, the support frame 38 capable of entering and retracting in a direction crossing the transport direction of a transported sheet, the cut blade 40 attached to the support frame to cut corners of a sheet in an inclined or curved manner, and the punch blade 42 that is provided in the support frame while being adjacent to the cut blade and that punches a punch hole in the sheet, includes a waiting step (position of the support frame 38 in FIG. 14) of shifting the support frame to the transport path to wait for arrival of a sheet, a lead edge cut step (FLC, RLC in FIG. 14) of halting the sheet after the sheet arrives, and cutting corners on the lead edge side of the sheet, a punching step (FP, RP in FIG. 21) of transporting the sheet after cutting corners on the lead edge side of the sheet, halting the sheet, shifting in the direction crossing the transport direction of the sheet, and punching punch holes in predetermined positions of the sheet, an end edge cut step (FEC, RCE cut in feeding backward in FIG. 21) of once transporting the sheet backward after punching the punch holes in the sheet, halting the sheet, and cutting corners on the end edge side of the sheet, and a discharge step of discharging the sheet with corners on the end edge side of the sheet cut.

According to the disclosure, the apparatus is relatively lightweight and compact, it is possible to cut corners at the lead edge and end edge of a sheet in an inclined or curved manner, and punch holes by the punch blade inside the same frame for entering/retracting, and further, it is possible to perform corner cut•punch by switching back the sheet.

In addition, in the description of the effects in the Embodiments in the foregoing, for each portion of the Embodiments, the member corresponding to each component in the scope of the claims is shown in the parenthesis, or assigned the reference numeral to clarify the relationship between both the portion and the component.

Further, the present invention is not limited to the above-mentioned Embodiments, various modifications thereof are capable of being made in the scope without departing from the invention, and all technical matters included in the technical ideas described in the scope of the claims are subjects of the invention. The Embodiments described previously illustrate preferred examples, a person skilled in the art is capable of achieving various types of alternative examples, corrected examples, modified examples or improved examples from the content disclosed in the present Description, and the examples are included in the technical scope described in the scope of the claims attached herewith.

In addition, this application claims priority from Japanese Patent Application No. 2015-238732 filed on Dec. 7, 2015 in Japan, Japanese Patent Application No. 2015-238733 filed on Dec. 7, 2015, Japanese Patent Application No. 2015-238734 filed on Dec. 7, 2015, and Japanese Patent Application No. 2015-238735 filed on Dec. 7, 2015, incorporated herein by reference.

The invention claimed is:

1. A corner cut apparatus including a transport path for transporting a sheet to enter into the transport path in a crossing direction so as to cut corners of the sheet, comprising:

a cut blade frame adapted to support a cut blade shifting with respect to a sheet surface;

a receiving blade frame adapted to support a receiving blade for receiving the shifting cut blade; and a drive member adapted to cause the cut blade frame and the receiving blade frame to enter into the transport path of the sheet;

a joint portion to mutually install the cut blade frame and the receiving blade frame fixedly as a support frame, wherein the joint portion is disposed on an outer side of the cut blade and the receiving blade in a direction crossing a sheet transport direction.

2. The corner cut apparatus according to claim 1, wherein the cut blade and the receiving blade are formed in a shape of cutting corners of the sheet in an inclined or arc manner as a substantially line symmetrical blade shape with respect to an entry direction as a reference line.

3. The corner cut apparatus according to claim 1, wherein the cut blade frame and the receiving blade frame of the support frame are fixedly joined with a distance therebetween set.

4. The corner cut apparatus according to claim 3, wherein the support frame is provided as a pair opposed to each other in the direction crossing the sheet transport direction, and each of support frames is provided to be able to enter and retract into/from the transport path of the sheet.

5. The corner cut apparatus according to claim 4, wherein each of the support frames as a pair is provided with a cut blade drive section that shifts the cut blade to the sheet surface.

6. The corner cut apparatus according to claim 5, wherein each of the support frames as a pair is provided with a drive section to shift independently to be able to enter and retract in the entry direction.

7. An image formation apparatus comprising:

an image formation section adapted to perform image formation on a sheet; and a corner cut apparatus adapted to cut corners of the sheet from the image formation section, wherein the corner cut apparatus is provided with a configuration according to claim 1.

8. An image formation apparatus comprising:

an image formation section adapted to perform image formation on a sheet;

a reading section adapted to read an image of an original document above the image formation section; and sheet discharge space of the sheet subjected to image formation between the reading section and the image formation section, wherein the corner cut apparatus provided with a configuration according to claim 1 is disposed in the sheet discharge space.

9. The corner cut apparatus according to claim 1, wherein blade shapes of the cut blade and the receiving blade are a back-to-back shape with an entry direction as a reference line.

* * * * *